US006048002A

United States Patent [19]

Ohta et al.

[11] Patent Number: 6,048,002

[45] Date of Patent: Apr. 11, 2000

[54] DOOR LOCKING-UNLOCKING SYSTEM FOR VEHICLE

[75] Inventors: Satoshi Ohta, Kosai; Takayoshi Aoyama, Toyohashi, both of Japan

[73] Assignee: Asmo Co., Ltd., Japan

[21] Appl. No.: 09/247,626

[22] Filed: Feb. 10, 1999

[30] Foreign Application Priority Data

Feb. 20, 1998 [JP] Japan ..... 10-039401
Feb. 20, 1998 [JP] Japan ..... 10-056284

[51] Int. Cl.[7] ..... E05C 3/06

[52] U.S. Cl. ..... 292/201; 292/216; 292/DIG. 23; 292/DIG. 42

[58] Field of Search ..... 292/201, 216, 292/DIG. 23, DIG. 42

[56] References Cited

U.S. PATENT DOCUMENTS

| | | | |
|---|---|---|---|
| 4,948,183 | 8/1990 | Yamada | 292/199 |
| 4,974,885 | 12/1990 | Yokoyama | 292/201 |
| 4,986,579 | 1/1991 | Ishikawa | 292/201 |
| 5,411,302 | 5/1995 | Shimada | 292/201 |
| 5,427,421 | 6/1995 | Hamaguchi | 292/216 |
| 5,765,884 | 6/1998 | Armbruster | 292/216 |
| 5,865,481 | 2/1999 | Bushmann | 292/216 |
| 5,938,252 | 8/1999 | Uemura et al. | 292/201 |
| 5,938,253 | 8/1999 | Szablewski et al. | 292/216 |
| 5,961,163 | 10/1999 | Brackmann et al. | 292/201 |
| 5,979,951 | 11/1999 | Shimura | 292/216 |

FOREIGN PATENT DOCUMENTS 62-101782 of 1987 Japan .

*Primary Examiner*—Teri Pham
*Attorney, Agent, or Firm*—Fish & Richardson P.C.

[57] ABSTRACT

A door closing system for locking and unlocking a door using a single actuator has a motor, a latch to be engaged with a door striker and a driving cam for driving the latch. An output shaft of the motor is disposed in parallel with a shaft which rotatably holds the latch and the driving cam, thereby reducing an installment space of the latch and the driving cam. Further, the actuator has plural reduction gears rotated by the motor, and a pattern is disposed on a surface of one of the reduction gears. First to third contacts are disposed to slide on the pattern, thereby producing detection signals of a rotation position of the reduction gear. An operation state of the door closing system is detected according to the detected rotation position of the reduction gear. Thus, the door closing system can be controlled accurately with a single detection sensor.

12 Claims, 16 Drawing Sheets

DOOR LOCKING-UNLOCKING SYSTEM FOR VEHICLE

CROSS REFERENCE TO RELATED APPLICATION

This application relates to and incorporates herein by reference Japanese Patent Application Nos. 10-39401 filed on Feb. 20, 1998, and 10-56284 filed on Feb. 20, 1998.

BACKGROUND OF THE INVENTION

1. Field of the Invention

The present invention relates generally to a door locking-unlocking system for locking and unlocking a door, and particularly to a door closing system for fully closing a side door or a trunk door of a vehicle by forcing a latch of the door closing system to be engaged with a door striker.

2. Related Art

Conventionally, closing a door of a vehicle requires a relatively large force due to reactive force of a weatherstrip attached to the door or lock resistance of the door occurring immediately before the door is fully closed. To overcome this problem, an electrically-driven automatic door closing system is developed. When the door closing system detects that a door is closing and a latch of the door closing system starts being engaged with a door striker, the door closing system fully closes the door by forcing the latch to be engaged with the striker. Generally, the door closing system performs two operations; an unlocking operation for unlocking the door and a latch pulling operation for forcing a latch of the door closing system to be engaged with a door striker when the latch starts being engaged with the striker. Conventionally, the two operations of the door closing system are independently controlled by two electric actuators. Therefore, manufacturing cost and size of the door closing system may be increased. Further, when such a large-sized door closing system is used for the trunk door, a capacity of a trunk may be decreased.

To solve these problems, JP-B2-5-27748 discloses a door closing system having a door lock system, in which the unlocking operation and the latch pulling operation are performed by a single electric actuator.

That is, as shown in FIG. 24A, a door lock system 51 installed in a trunk door of a vehicle has a latch 53 having a recessed portion 53*a* to be engaged with a striker 52 mounted on the vehicle. The latch 53 is rotatably held by a shaft 54, and is constantly biased in a clockwise direction in FIG. 24A. When the door is closed by a relatively weak force, the latch 53 hits the striker 52, but insufficiently rotates to be positioned as shown in FIG. 24B. At this point, a pawl (ratchet) 55 is latched, thereby restricting further moving of the latch 53. On the other hand, when the door is closed by a relatively large force, the latch 53 hits the striker 52, and sufficiently rotates to be positioned as shown in FIG. 24C, so that the latch 53 is fully engaged with the striker 52. At 25 this point, the pawl 55 is latched, thereby restricting further moving of the latch 53.

As shown in FIG. 23, a door closing system 56 having the door lock system 51 has a single reversible motor 57 as an actuator. When the reversible motor 57 rotates forward, a rotation plate 58 rotates in a clockwise direction in FIG. 23 from a neutral position thereof. As a result, one end of an output member 59 attached to the rotation plate 58 makes contact with an arm 60 and rotates the arm 60, thereby pulling a rod 61. When the rod 61 is pulled, the latch 53 which starts being engaged with the striker 52 is forced to be rotated to be fully engaged with the striker 52.

On the other hand, when the reversible motor 57 is rotated in reverse by a door opening system, the rotation plate 58 rotates in a counterclockwise direction in FIG. 23 from the neutral position. As a result, the other end of the output member 59 hits an arm 62 and rotates the arm 62, thereby pulling a rod 63. When the rod 63 is pulled, the pawl 55 holding the latch 53 to be fully engaged with the striker 52 is rotated so that the latch 53 is released from the striker 52. As a result, the door is unlocked.

However, in this door closing system 56, the rotation plate 58 rotated to pull the rods 61, 63 needs to be disposed to be perpendicular to the latch 53. As a result, the door closing system 56 cannot be reduced in size sufficiently.

Further, the door closing system 56 has two position detection sensors such as microswitches which determine a timing for stopping the actuator when the latch 53 is fully engaged with the striker 52, and a timing for unlocking the door and stopping the actuator at an original initial position. Therefore, the door closing system 56 needs to have an extra space in which the two detection sensors are installed. As a result, reduction in size of the door closing system 56 is further restricted.

Further, in the door closing system 56, when power supply to the actuator is shut off to tentatively stop the actuator and resumes, it can not be determined whether the door closing system 56 has been performing a latch pulling operation for pulling the latch 53 to be fully engaged with the striker 52, or an unlocking operation for unlocking the door before the actuator is stopped, even though the two position detection sensors are used. As a result, the door closing system 56 may erroneously unlock the door when the latch 53 should be pulled to be engaged with the striker 52, or pull the latch 53 when the door should be unlocked.

SUMMARY OF THE INVENTION

It is an object of the present invention to provide a compact door locking-unlocking system which pulls a latch to be engaged with a door striker so that a door is fully closed and unlocks the door, using a single actuator.

It is another object of the present invention to provide a compact door locking-unlocking system which pulls a latch to be engaged with a door striker so that a door is fully closed and unlocks the door, using a single actuator, and is made of a reduced number of parts through a reduced number of assembly processes.

It is a further object of the present invention to provide a compact door locking-unlocking system having a single actuator, in which an operation state of the actuator is constantly detected so that the system resumes its operation properly even when power supply to the system is tentatively shut off and resumes.

According to the present invention, a door locking-unlocking system for locking and unlocking a door has an actuator having an output shaft and a latch to be engaged with a striker when the door is closed. The door locking and unlocking system also has a latching member, a pulling member, a releasing member and a cam. The latching member is engaged with the latch and restricts the latch from moving from a full closing position where the door is fully closed. The pulling member is engaged with the latch and rotates the latch from a closing start position where the latch starts being engaged with the striker and the door starts being closed to the full closing position. The releasing member releases the latch from the latching member. The cam having a rotation shaft is driven by the actuator to rotate and drive the pulling member and the releasing member. The rotation shaft of the cam is disposed in parallel with a rotation shaft of the latch. Therefore, the cam and latch are disposed in a relatively small space. Further, the output shaft of the actuator is disposed in parallel with the rotation shaft of the latch. Therefore, power transmission from the actuator to the cam is performed in a relatively small space. Thus, size of the door locking-unlocking system is reduced.

Preferably, the cam is rotatably held by the rotation shaft of the latch, thereby further reducing size of the system.

Preferably, the door locking-unlocking system has a rotation body driven by the actuator. An electrical conductive pattern is disposed on a surface of the rotation body. A detection means is disposed to slide on the pattern, thereby producing a detection signal which indicates a rotation position of the rotation body. Thus, the rotation position of the rotation body is detected without using plural position detection sensors, thereby reducing the number of parts, the number of assembly processes, and size of the system. Further, an operation state of the actuator is determined according to the rotation position of the rotation body. Therefore, the system is enabled to resume its operation properly even when power supply to the system is tentatively shut off and resumes.

BRIEF DESCRIPTION OF THE DRAWINGS

This and other objects and features of the present invention will become more readily apparent from a better understanding of the preferred embodiments described below with reference to the accompanying drawings. In the drawings.

Figure 10:
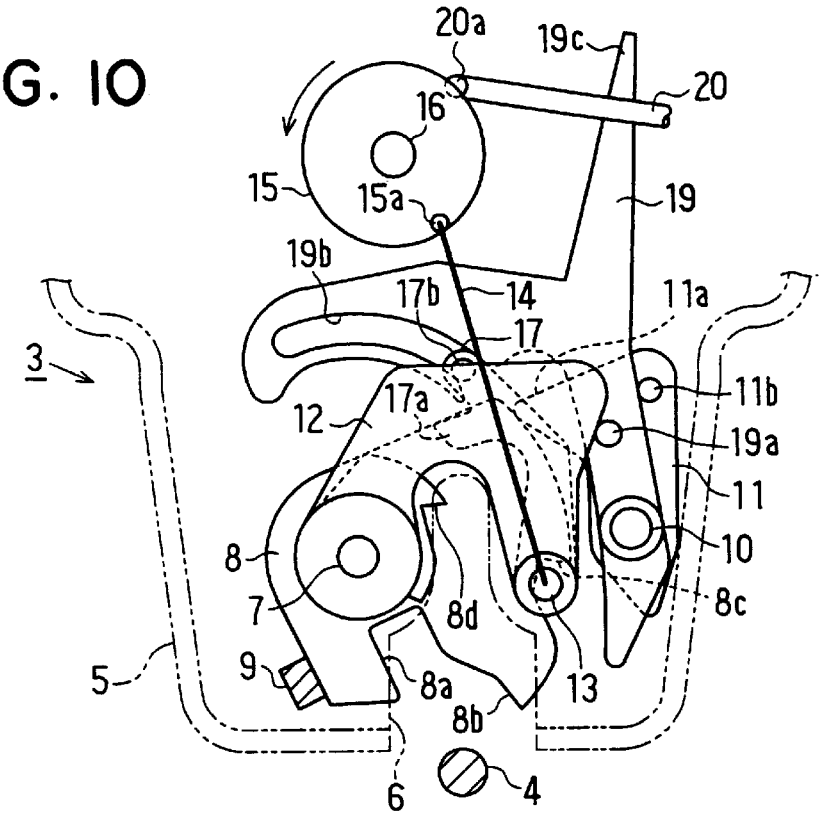
Figure 11:
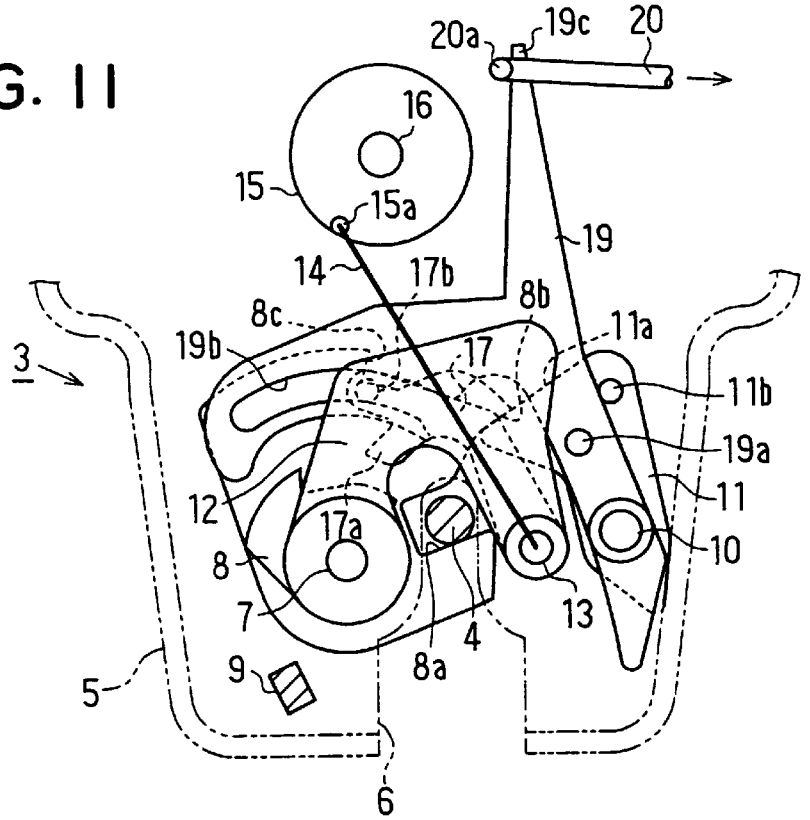
Figure 12:
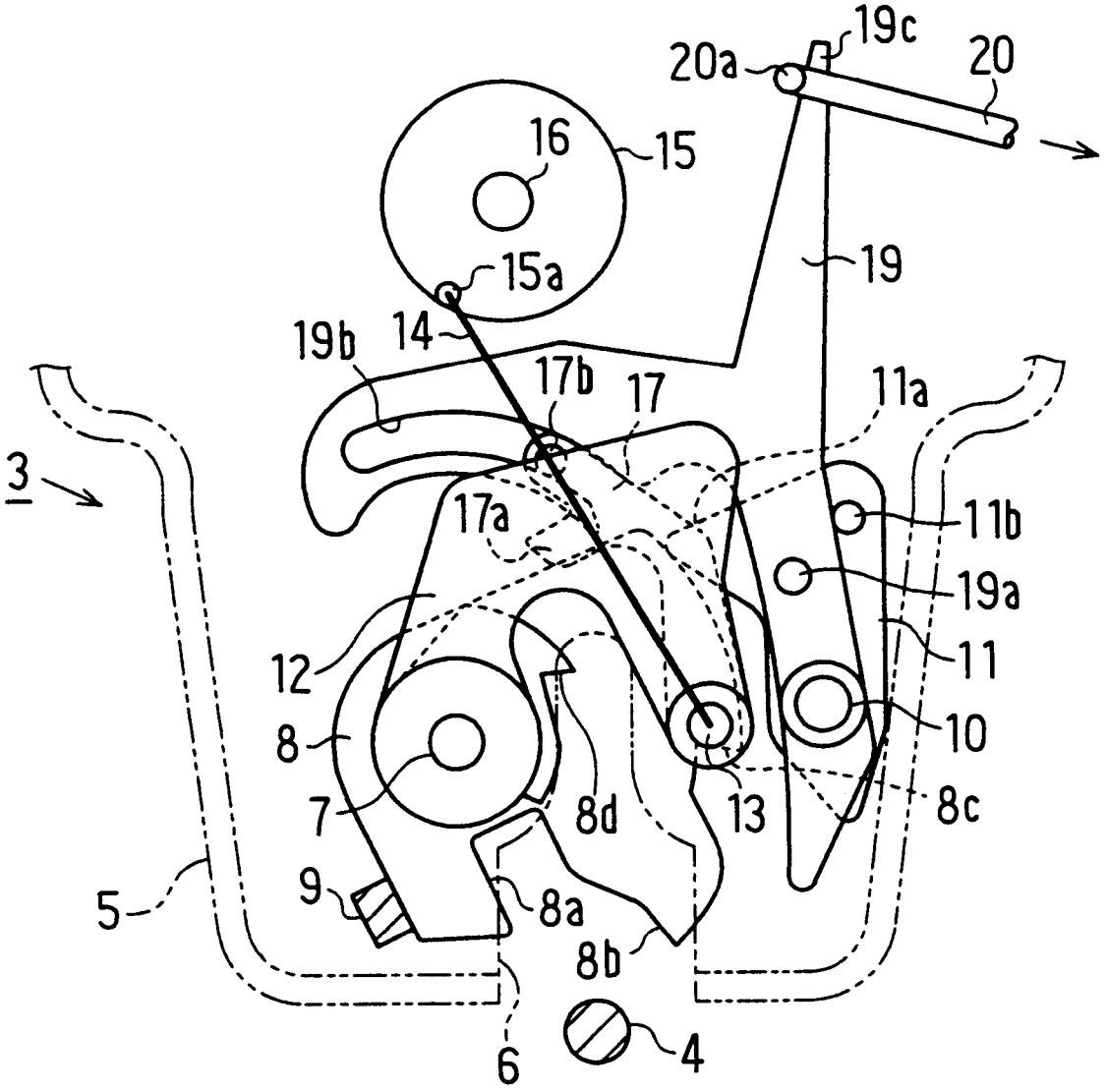
Figure 13A:
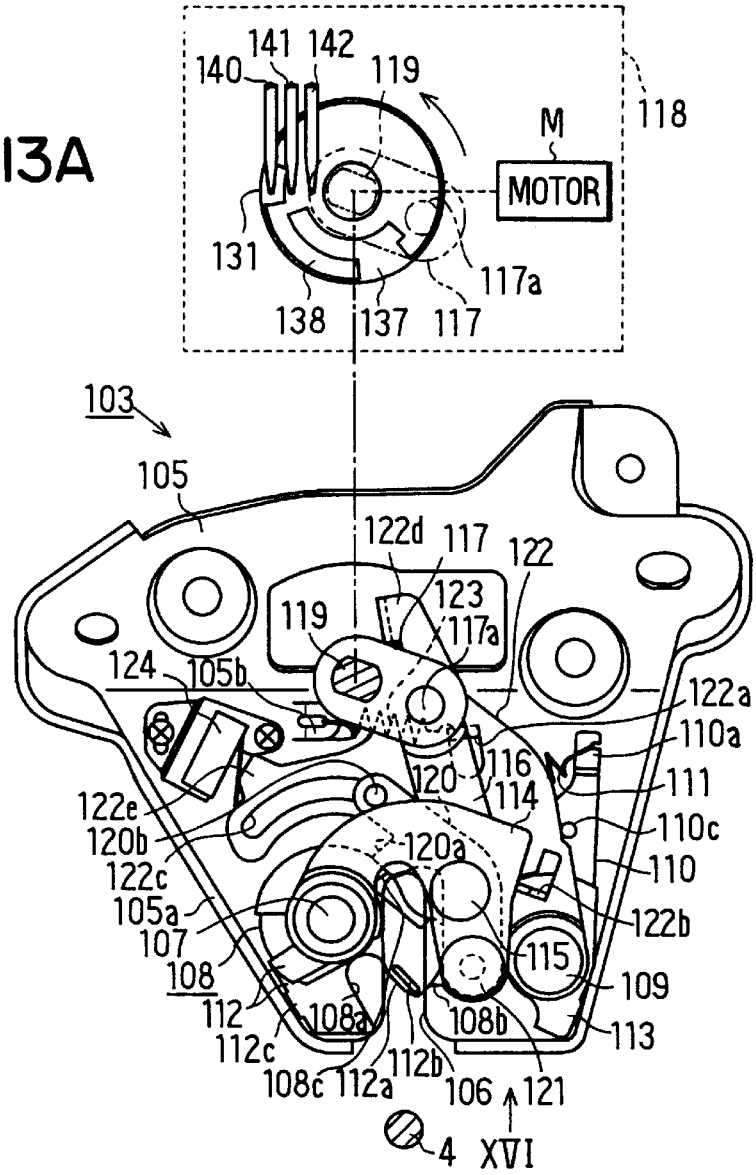
Figure 13B:
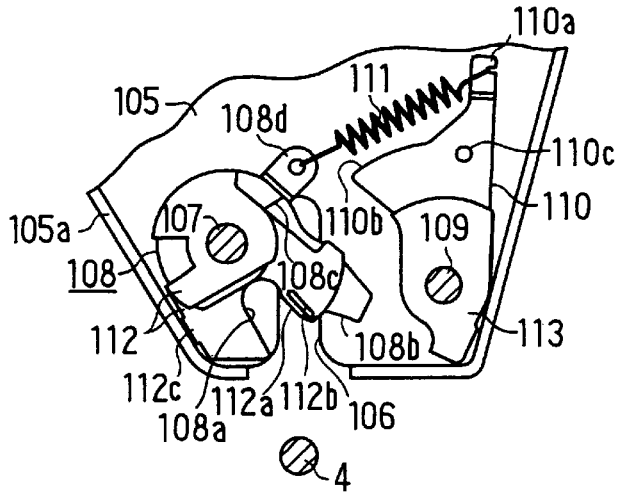
Figure 14:
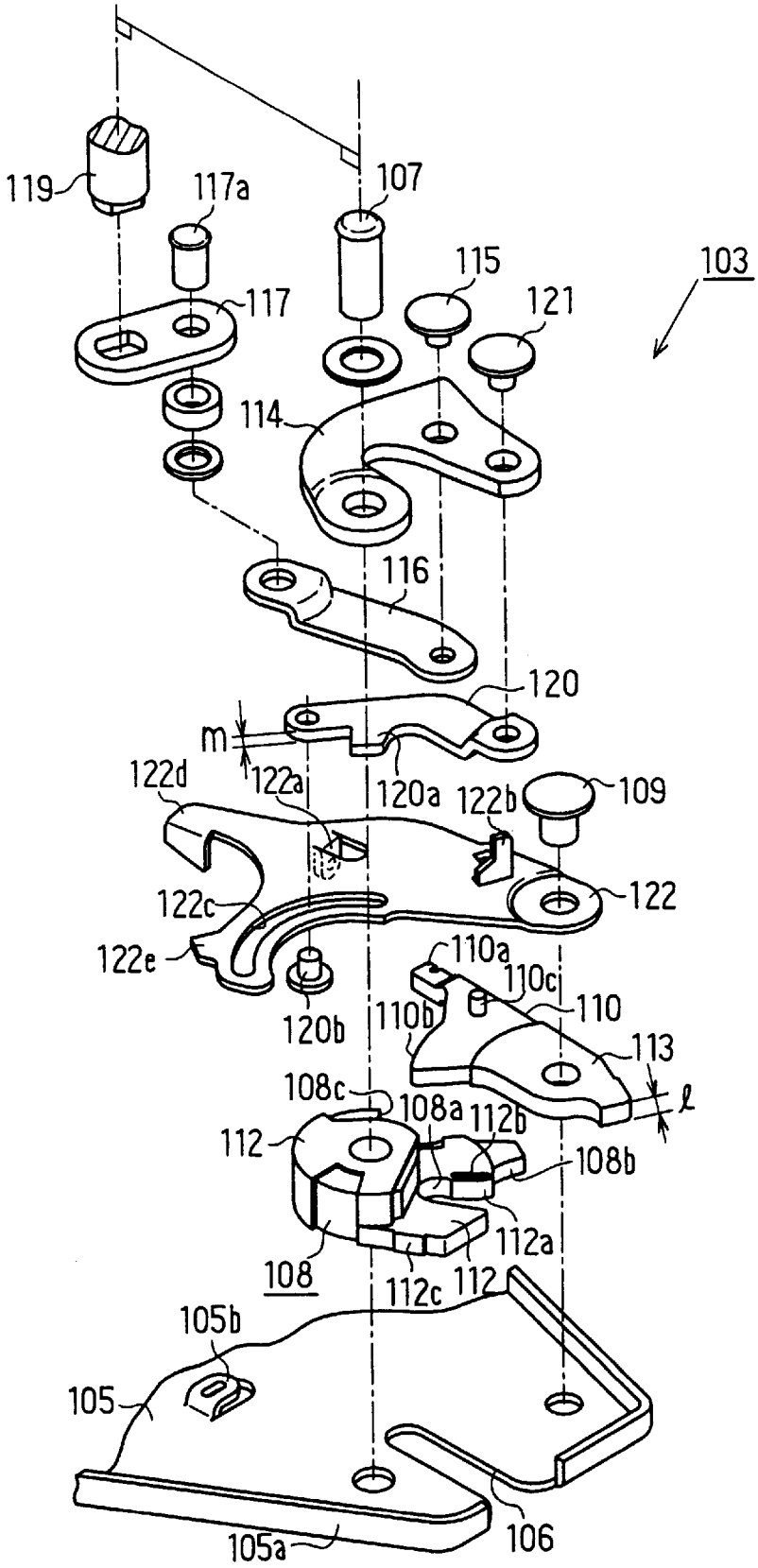
Figure 15:
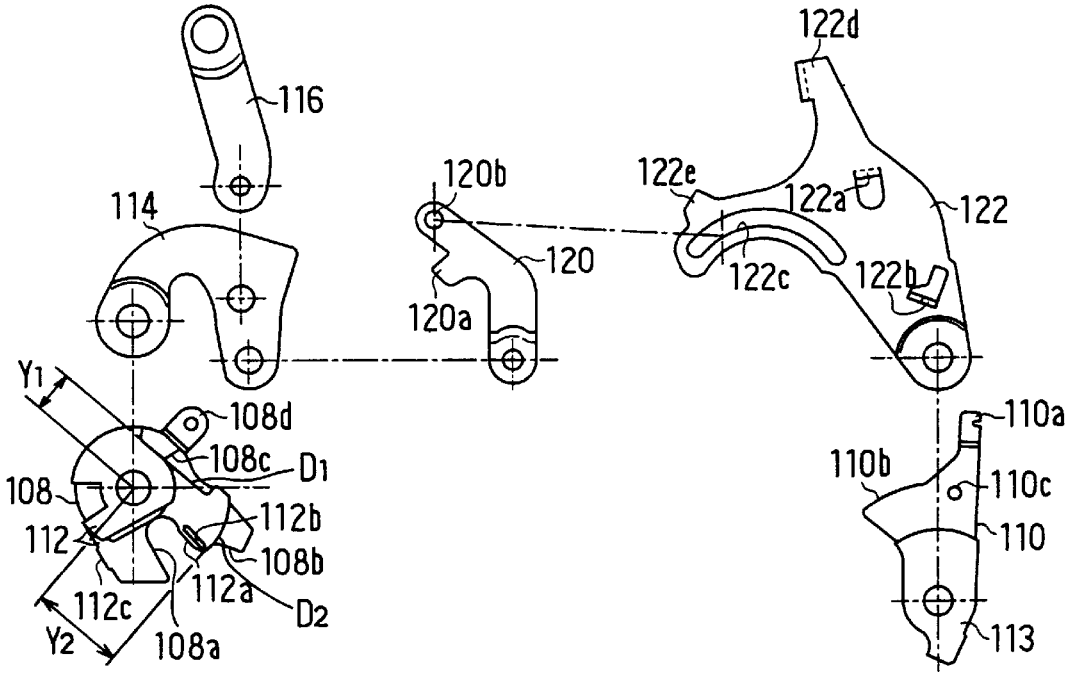
Figure 16:
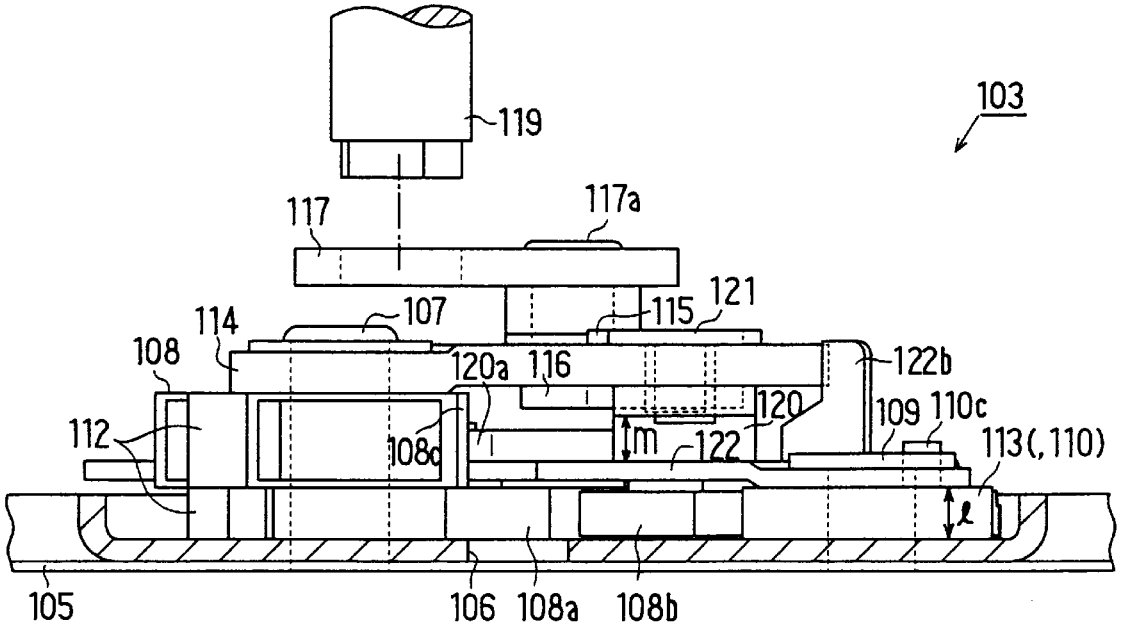
Figure 17A:
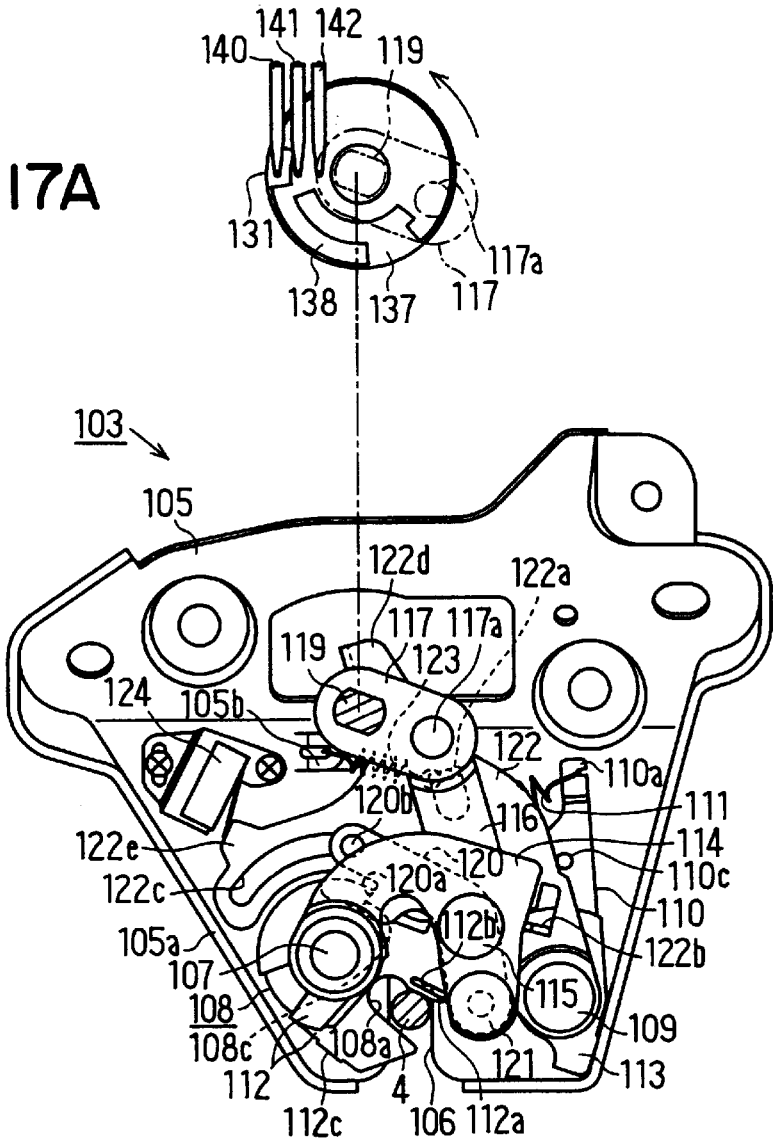
Figure 17B:
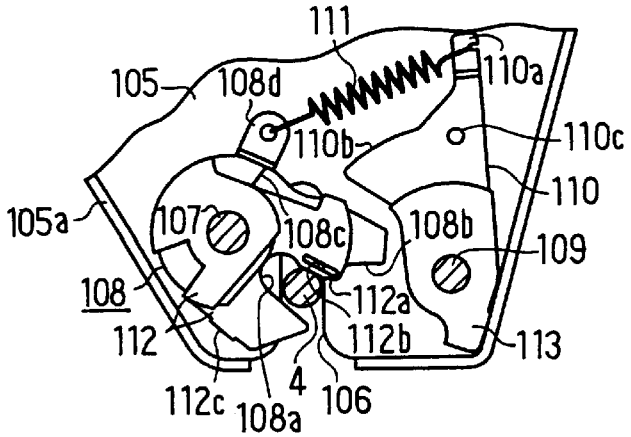
Figure 18A:
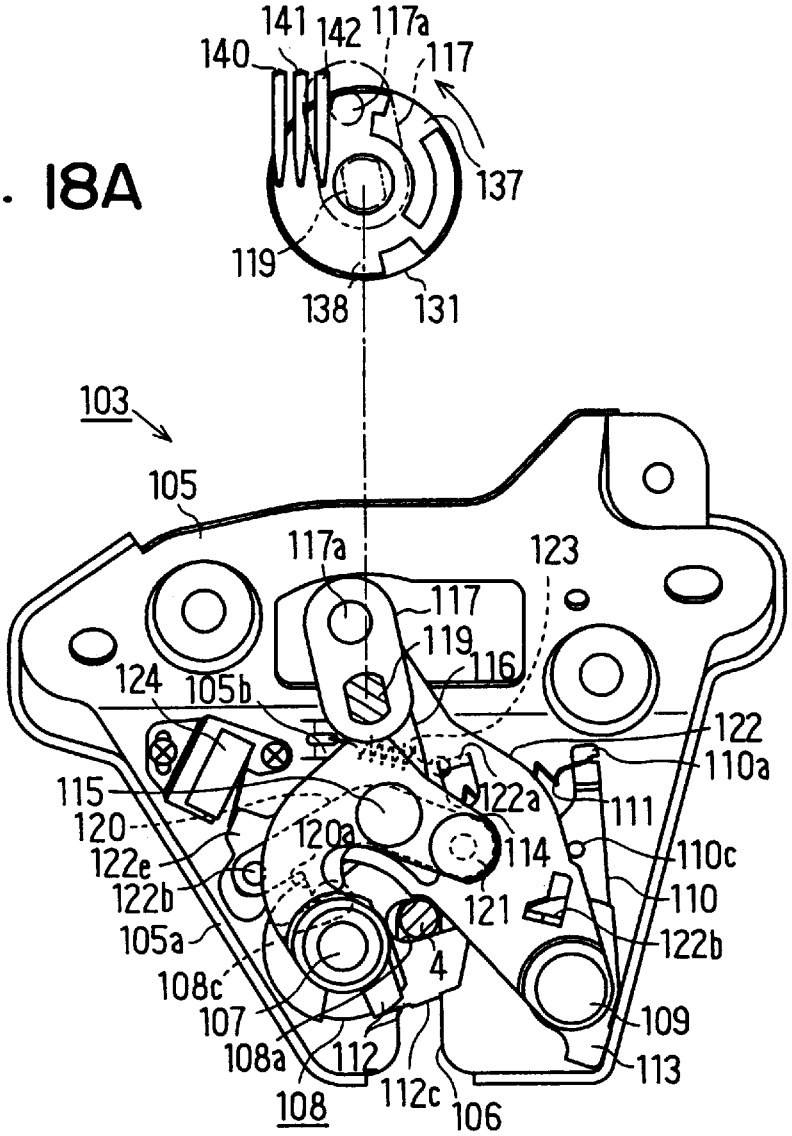
Figure 18B:
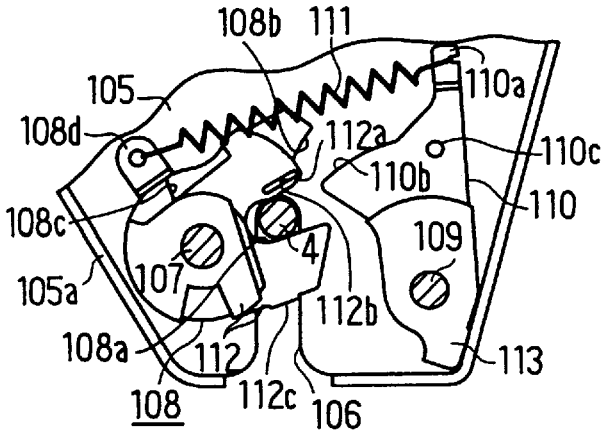
Figure 19A:
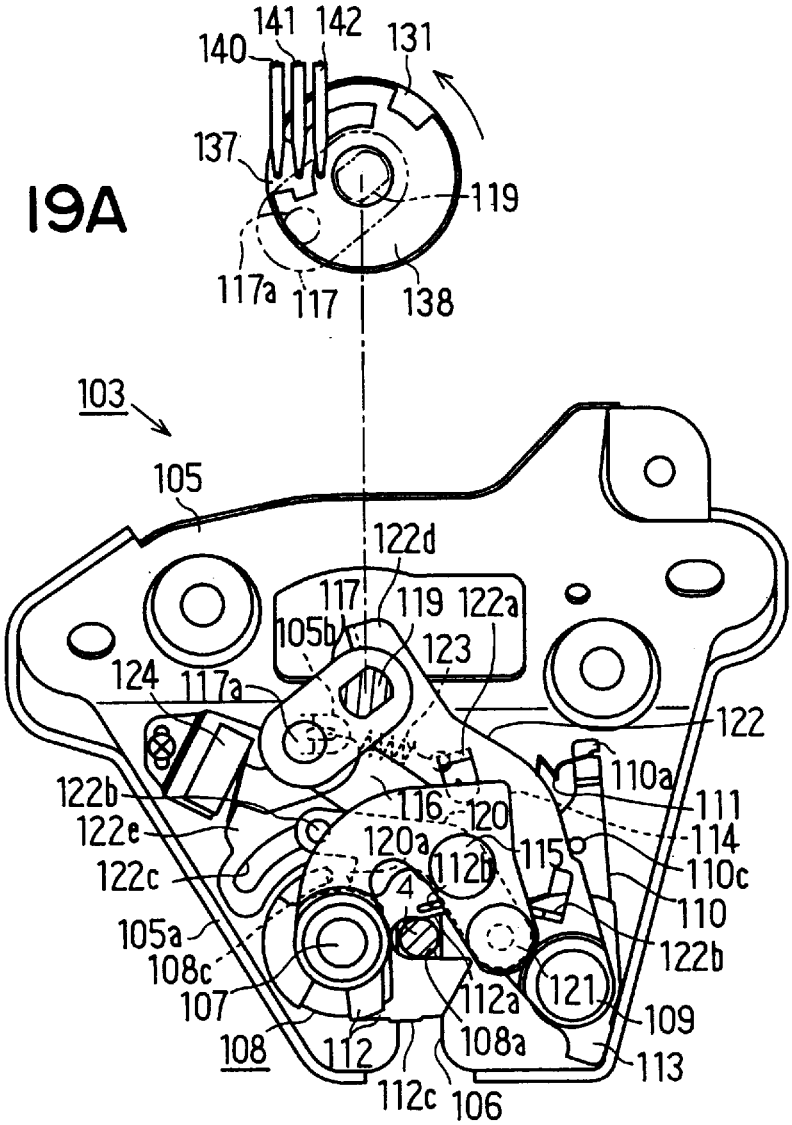
Figure 19B:
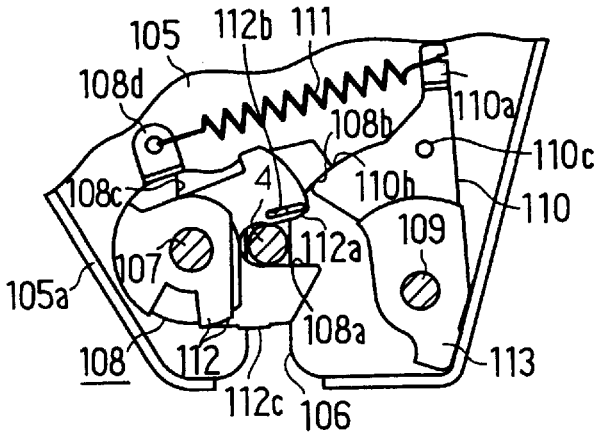
Figure 20A:
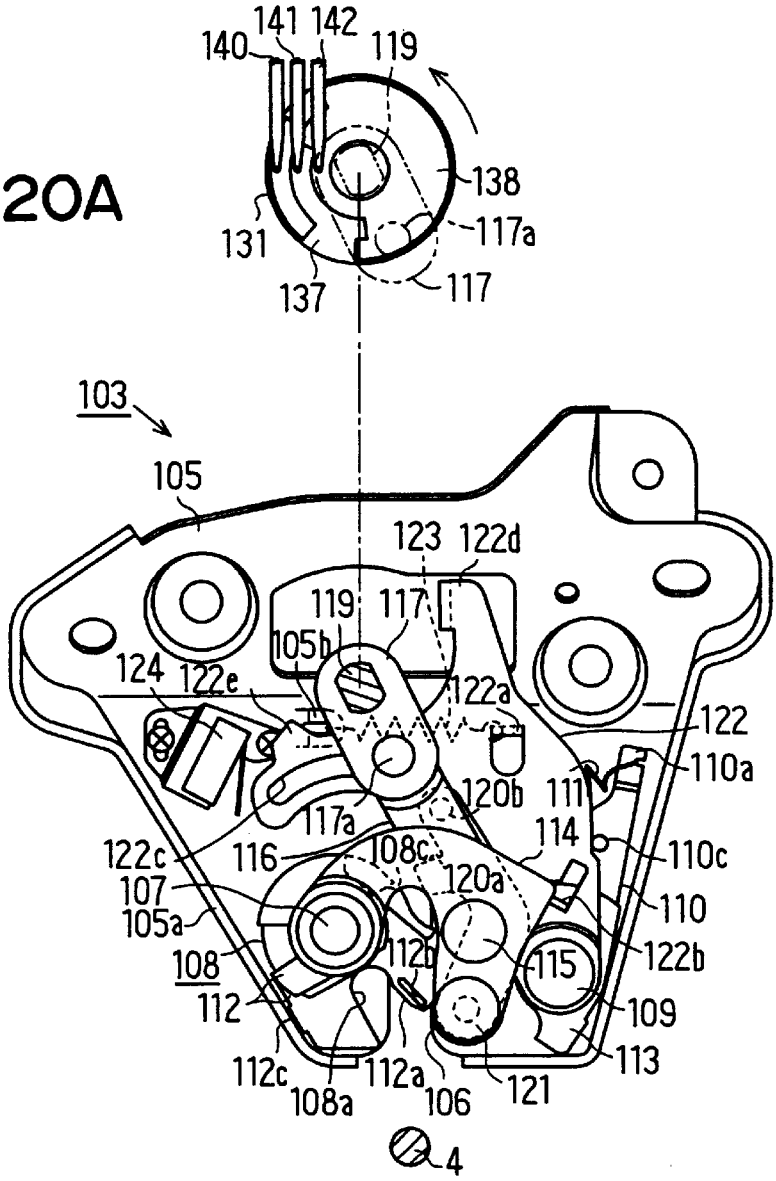
Figure 20B:
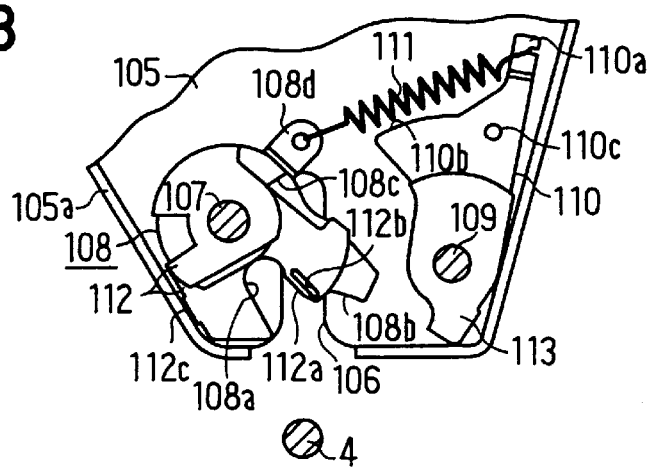
Figure 21:
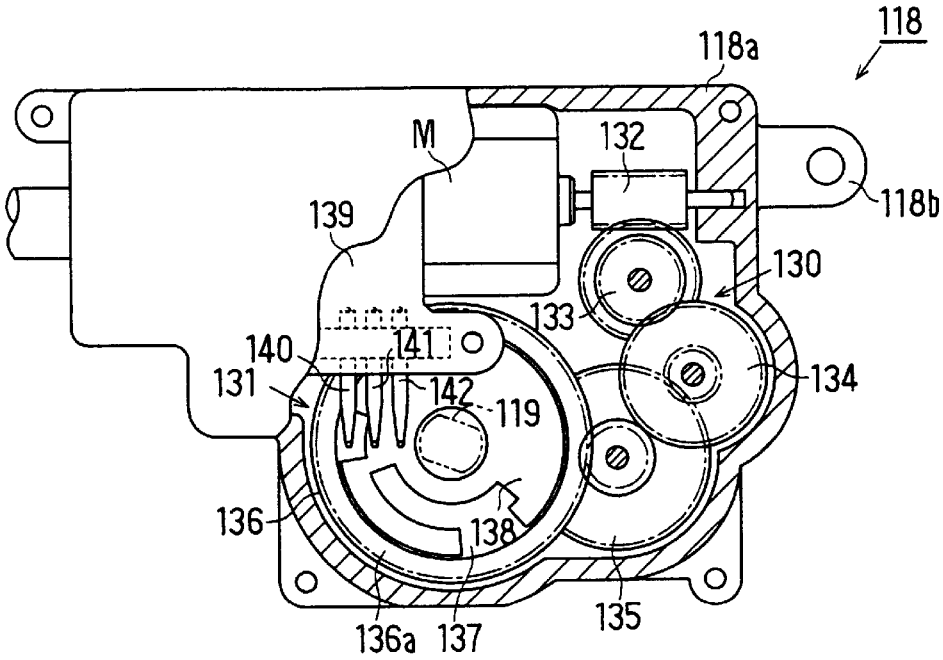
Figure 22:
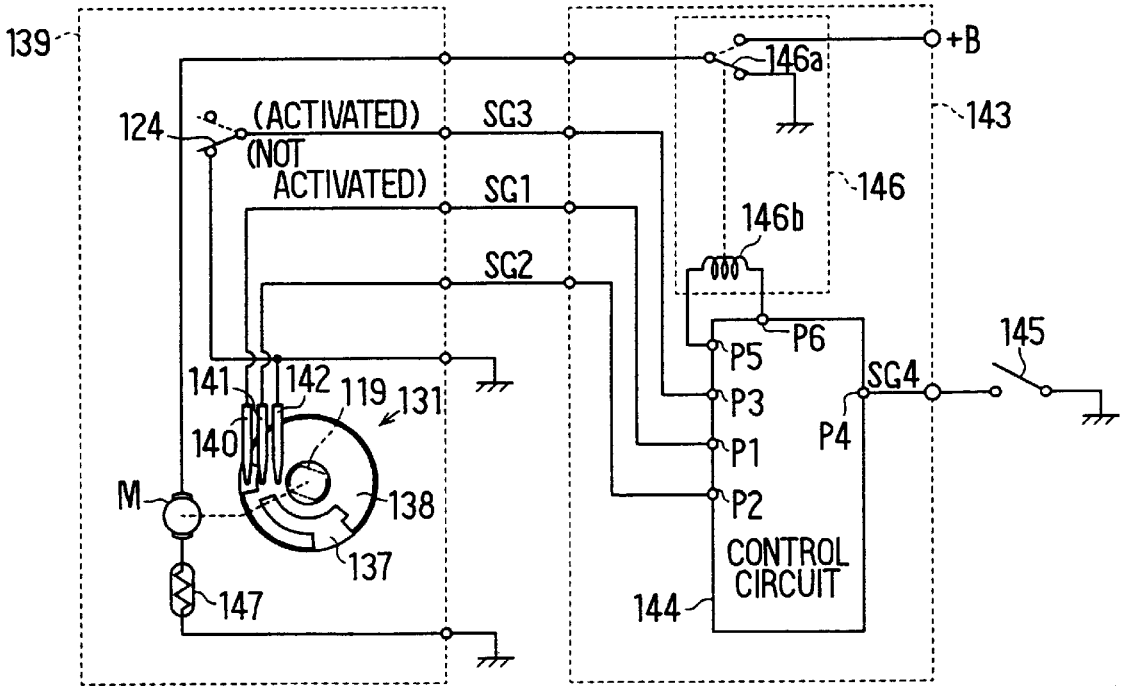
Figure 23:
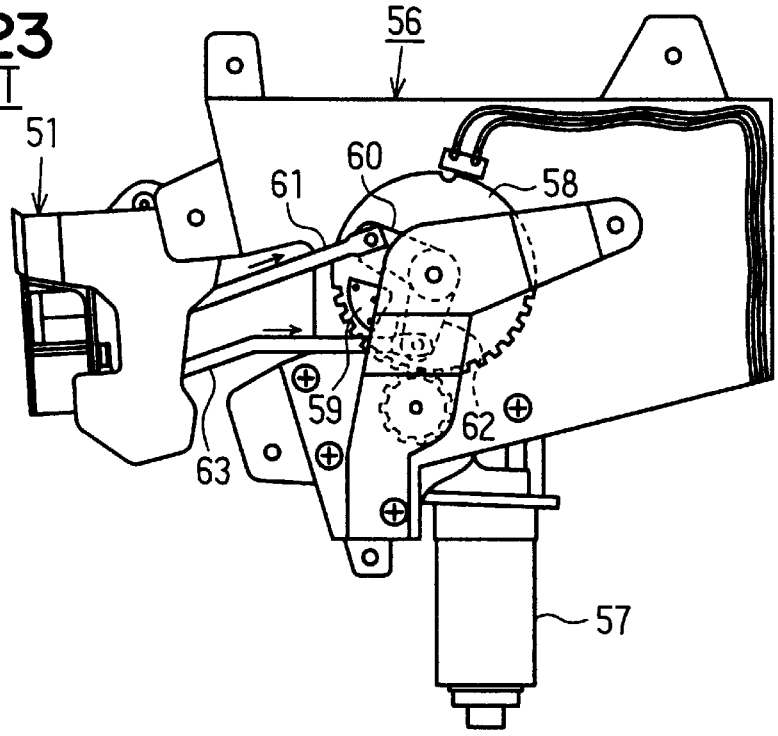
FIG. 23 PRIOR ART

FIG .9 is a schematic view showing the door closing system operating to open the trunk door in the first embodiment;

FIG. 10 is a schematic view showing the door closing system when the trunk door is opened in the first embodiment;

FIG. 11 is a schematic view showing the door closing system operating to unlock the trunk door through a key operation in the first embodiment;

FIG. 12 is a schematic view showing the door closing system when the trunk door is unlocked through the key operation in the first embodiment;

FIGS. 13A, 13B are schematic views showing a door closing system according to a second embodiment of the present invention;

FIG. 14 is an exploded perspective view showing the door closing system according to the second embodiment;

FIG. 15 is an exploded view showing components of the door closing system according to the second embodiment;

FIG. 16 is a side view taken from arrow XVI in FIG. 13A, showing the door closing system according to the second embodiment;

FIGS. 17A, 17B are schematic views showing the door closing system operating to close a trunk door in the second embodiment;

FIGS. 18A, 18B are schematic views showing the door closing system operating to close the trunk door in the second embodiment;

FIGS. 19A, 19B are schematic views showing the door closing system when the trunk door is fully closed in the second embodiment;

FIGS. 20A, 20B are schematic views showing the door closing system when the trunk door is opened in the second embodiment;

FIG. 21 is a schematic view showing an actuator used in the second embodiment;

FIG. 22 is an electric wiring diagram showing a control circuit of the door closing system according to the second embodiment;

FIG. 23 is a schematic view showing a conventional door closing system;and

Figure 24A:
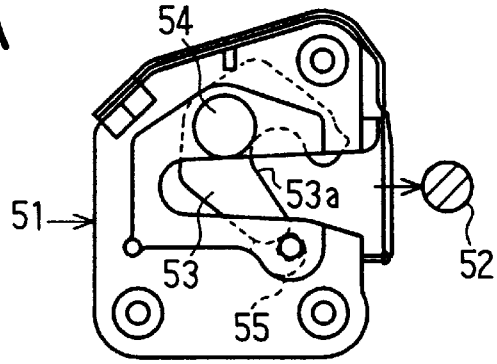
FIG. 24A PRIOR ART
Figure 24B:
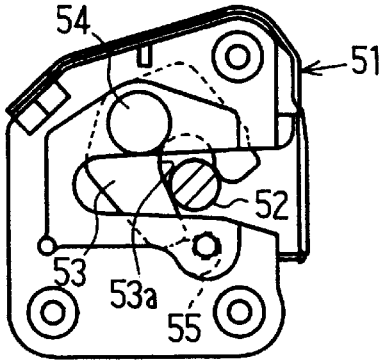
FIG. 24B PRIOR ART
Figure 24C:
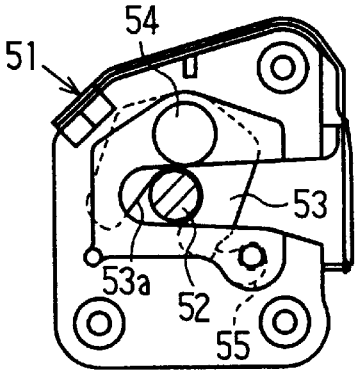
FIG. 24C PRIOR ART

FIGS. 24A, 24B, 24C are side views showing a door lock system of the convention door closing system in FIG. 23.

DETAILED DESCRIPTION OF THE PREFERRED EMBODIMENTS

Preferred embodiments of the present invention will be described with reference to the accompanying drawings.

(First Embodiment)

Figure 1:
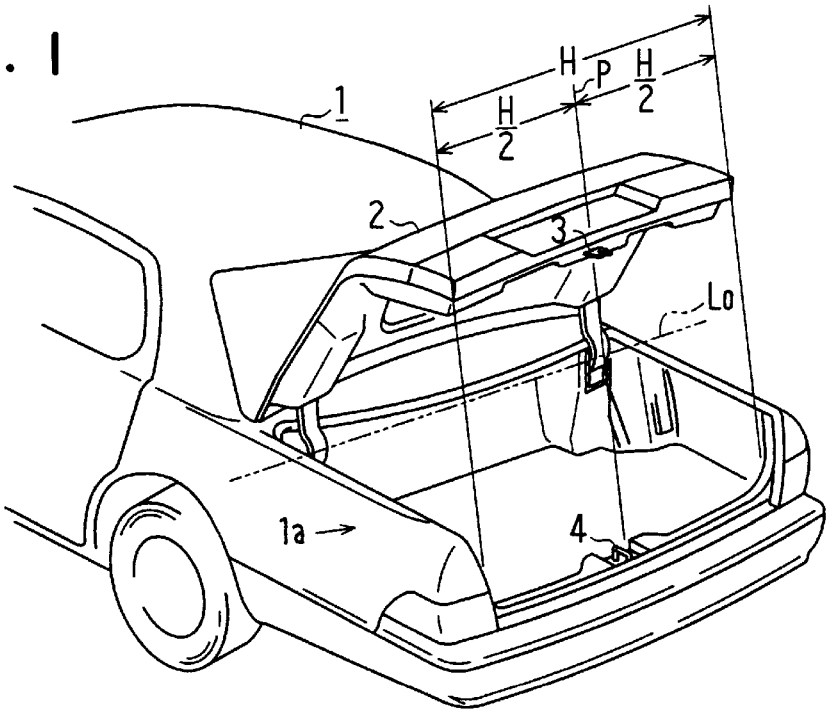
FIG. 1 is a perspective view showing a rear part of a vehicle using a door closing system according to a first preferred embodiment of the present invention.

A first preferred embodiment is shown in FIGS. 1–12. 3As shown in FIG. 1, a vehicle 1 has a trunk 1*a* in which baggages are loaded at a rear part. A trunk door 2 having an approximately square shape is mounted on an upper part of the trunk 1*a*, thereby forming a trunk space for accommodating baggages. The trunk door 2 is rotatably held at a base end thereof by a rotation shaft Lo disposed in parallel with a width direction of the vehicle 1. A free end (i.e., vehicle-rear-end) of the trunk door 2 is bent downwardly so that the trunk door 2 has an L-shaped cross-section.

A door closing system 3 for locking and unlocking the trunk door 2 is attached on the free end of the trunk door 2, at a center point P of a length H of the trunk door 2 in the width direction of the vehicle 1. On the other hand, a striker 4 to be engaged with the door closing system 3 is mounted on the vehicle 1 at a position corresponding to the door closing system 3. When the trunk door 2 starts being engaged with the striker 4, the door closing system 3 forces the striker 4 to be engaged with the trunk door 2, thereby fully closing and locking the trunk door 2. Since the door closing system 3 is disposed in the center point P of the trunk door 2 in the width direction of the vehicle 1, the trunk door 2 is fully closed in a stable manner.

Figure 2:
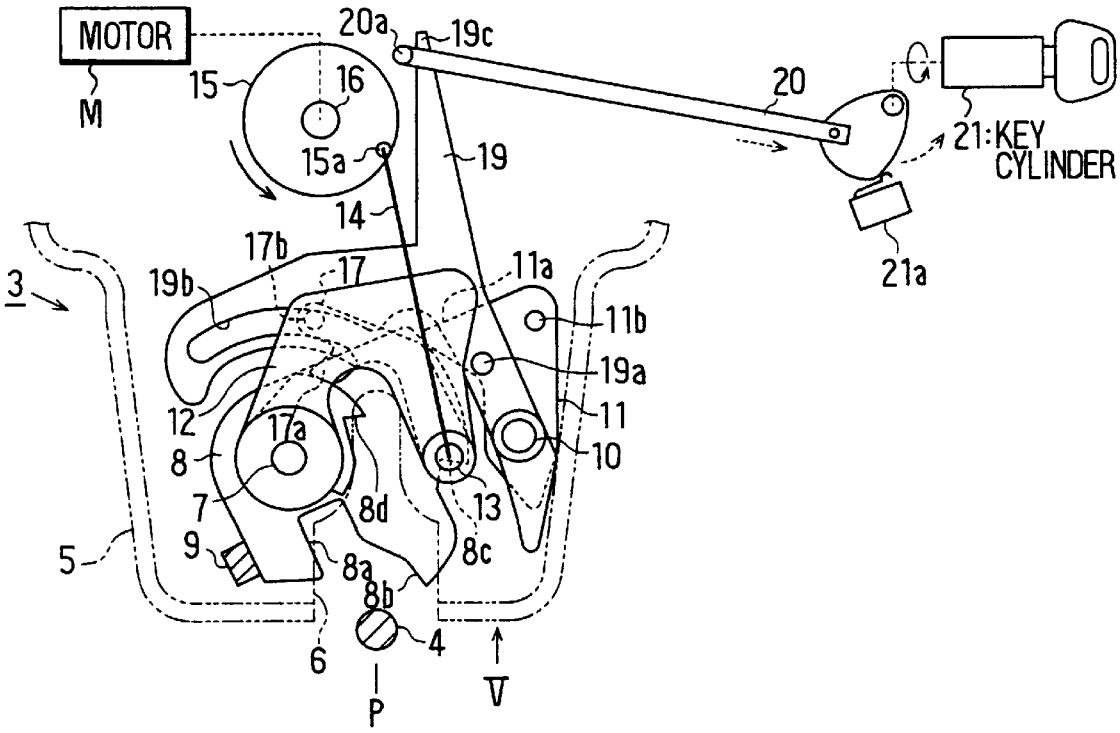
FIG. 2 is a schematic view showing the door closing system according to the first embodiment.
Figure 3:
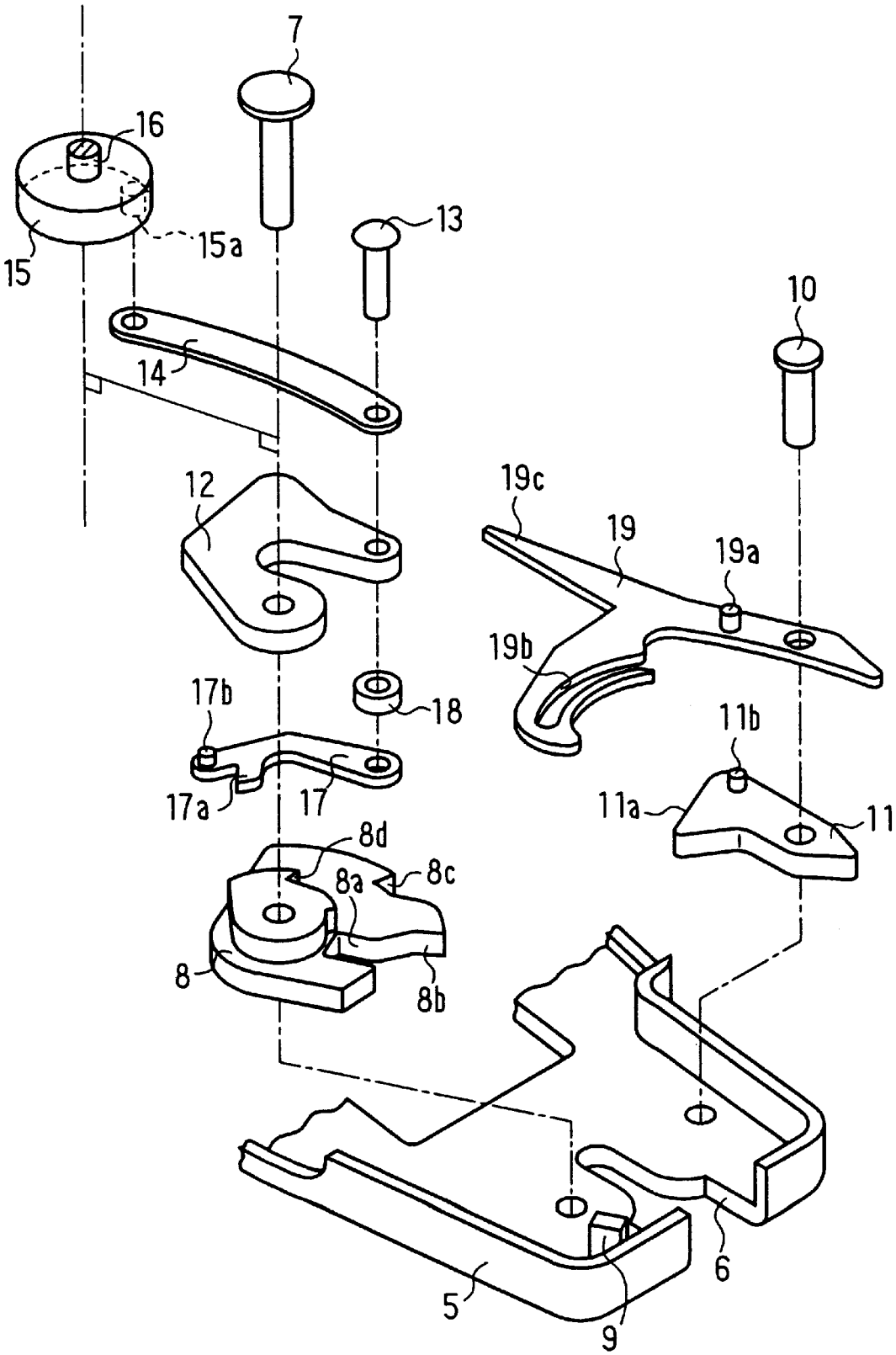
FIG. 3 is an exploded perspective view showing the door closing system according to the first embodiment.
Figure 4:
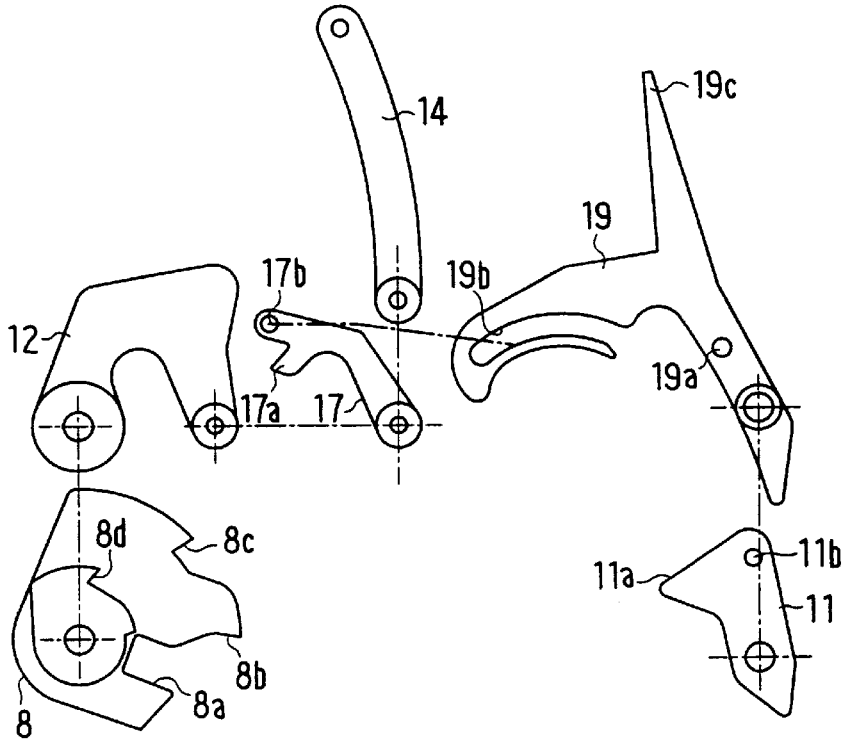
FIG. 4 is an exploded view showing components of the door closing system according to the first embodiment.
Figure 5:
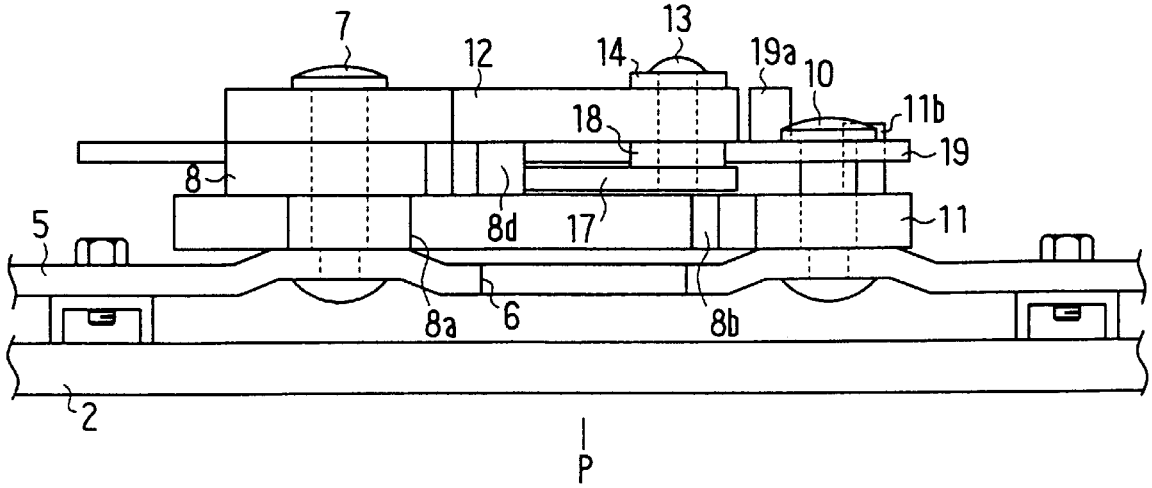
FIG. 5 is a side view taken from arrow V in FIG. 2, showing the door closing system according to the first embodiment.

As shown in FIGS. 2–5, the door closing system 3 has a base plate 5 to which components of the door closing system 3 are attached. In FIGS. 3, 4, each connection point between components of the door closing system 3 is shown by a transverse dashed line of action. The base plate 5 has an insertion passage 6 into which the striker 4 is inserted. The base plate 5 is secured to the vehicle 1 using bolts or the like, in such a manner that the insertion passage 6 is disposed on the center point P, and is parallel to the trunk door 2, as shown in FIG. 5. Further, as shown in FIG. 5, a rotational supporting shaft 7 is disposed in the vicinity of the insertion passage 6 so that the shaft 7 is perpendicular to the base plate 5. A latch 8 formed into a substantially circular plate is rotatably held by the shaft 7, and is biased by a spring (not shown) in a clockwise direction in FIG. 2. Moving of the latch 8 in the biased direction thereof is restricted by a stopper 9. In the present embodiment, as shown in FIG. 2, when the latch 8 makes contact with the stopper 9 and is restricted from moving further, the striker 4 is released from the latch 8, thereby unlocking the trunk door 2. The latch 8 is disposed to be parallel and adjacent to the trunk door 2, as shown in FIG. 5.

The latch 8 is formed into a two-stepped shape having upper and lower steps to have a two-stepped cross-section. Therefore, the latch 8 has larger thickness at a center part thereof than at a peripheral part thereof, and has upper and lower peripheral side surfaces. The lower peripheral side surface of the latch 8 has a recessed portion 8*a* for catching the striker 4, a latching surface 8*b* to be engaged with the striker 4 when the door 2 is fully closed, and a latching surface 8*c* to be engaged with the striker 4 when the latch 8 starts being engaged with the striker 4. The upper peripheral side surface of the latch 8 has an engaging groove 8*d*. The latching surfaces 8*b*, 8*c* and the engaging groove 8*d* are disposed on a side of the insertion passage 6 with respect to a rotation center of the latch 8 held by the shaft 7. That is, the latching surfaces 8*b*, 8*c* and the engaging groove 8*d* are disposed on a right side of the shaft 7 in FIG. 2.

Further, as shown in FIG. 5, a rotational supporting shaft 10 is disposed on a side opposite to the shaft 7 with respect to the insertion passage 6 in the vicinity of the insertion passage 6, in such a manner that the shaft 10 is perpendicular to the base plate 5. One end of a first ratchet 11 is rotatably held by the shaft 10. The first ratchet 11 is biased by a torsion spring (not shown) in a clockwise direction in FIG. 2 so that the first ratchet 11 makes contact with the lower peripheral side surface of the latch 8. Further, the other end of the first ratchet 11 has a latching surface 11*a* to be engaged with the latching surfaces 8*b*, 8*c* of the latch 8. When the latching surface 11*a* of the first ratchet 11 is engaged with the latching surfaces 8*b*, 8*c*, it is determined that the latch 8 starts being engaged with the striker 4. A latching pin 11*b* for releasing the first ratchet 11 from the latch 8 is also disposed on the other end of the first ratchet 11.

As shown in FIGS. 3, 5, a substantially C-shaped driving cam 12 is disposed above the latch 8. One end of the driving cam 12 is rotatably held by the shaft 7. Thus, the latch 8 and the driving cam 12 share the same shaft 7. Another supporting shaft 13 is disposed to pierce the other end of the driving cam 12 and to be perpendicular to the base plate 5. Further, a link member 14 for making a linkage between the shaft 13 and a rotation body 15 is disposed above the driving cam 12. One end of the link member 14 is rotatably connected to the shaft 13, and the other end of the link member 14 is rotatably connected to a connection pin 15*a* attached to a peripheral side of the rotation body 15. In the present embodiment, the link member 14 is formed into a curbed plate as shown in FIGS. 3, 4, although the link member 14 is shown as a straight line in FIGS. 2, and 6–12 for brevity.

The rotation body 15 is secured to an output shaft 16 of an electric motor M, so that the rotation body 15 rotates integrally with the output shaft 16. The motor M is a driving source of the door closing system 3, and is integrally secured to an upper center part of the base plate 5 using screws or the like. Thus, the output shaft 16 of the motor M is disposed at an approximately center point of the base plate 5. The motor M rotates the rotation body 15 only in one direction (i.e., counterclockwise direction in FIG. 2). Further, as shown in FIG. 3, the output shaft 16 of the motor M is parallel to the shaft 7 which rotatably holds both the latch 8 and the driving cam 12. Therefore, the driving cam 12 and the latch 8 are disposed parallel to each other in a compact space. As a result, power transmission from the motor M to the driving cam 12 is performed in a relatively small space, thereby reducing a size of the door closing system 3. Further, since the driving cam 12 and the latch 8 share the same shaft 7, the driving cam 12 and the latch 8 are disposed in a relatively small space, thereby further reducing the size of the door closing system 3. Preferably, the motor M is secured to the base plate 5 using plural fastening members such as screws disposed to surround the output shaft 16 of the motor M.

Figure 8:
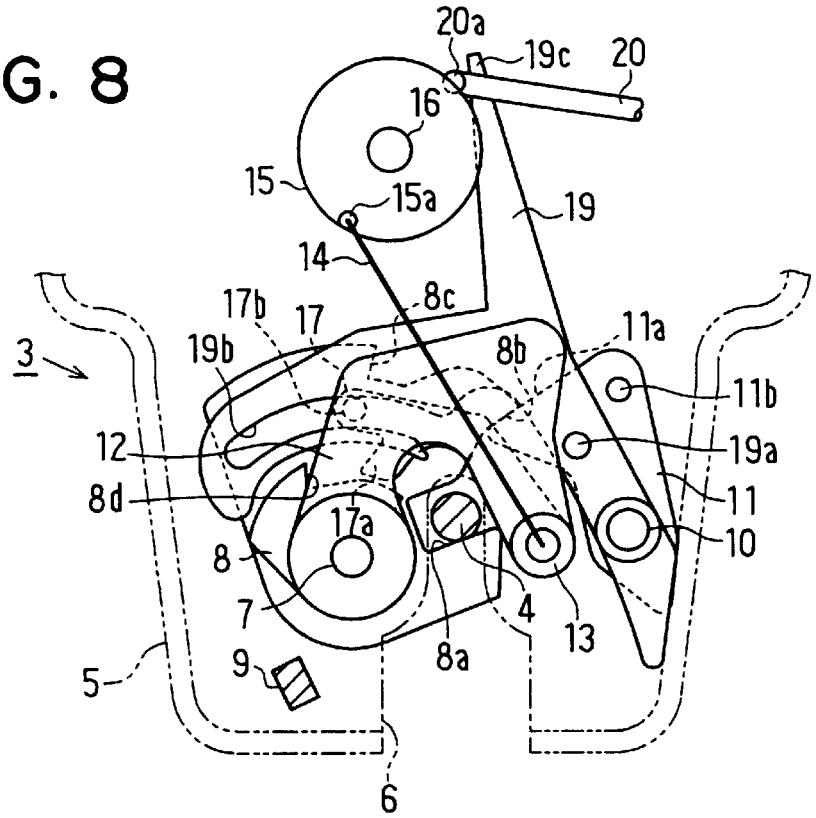
FIG. 8 is a schematic view showing the door closing system when the trunk door is fully closed in the first embodiment.

In FIG. 2, the rotation body 15 is set to an initial position. When the trunk door 2 is opened, the rotation body is set to the initial position. In FIG. 8, the rotation body 15 is set to a home position. When the trunk door 2 is fully closed, the rotation body 15 is set to the home position. When the rotation body 15 is set to either the initial or home position, a position of the rotation body 15 is detected by a detection sensor such as a microswitch (not shown).

When the latch 8 starts being engaged with the striker 4, the position of the rotation body 15 is detected by the detection sensor (not shown). The motor M is driven to rotate the rotation body 15 from the initial position to the home position according to the detected position of the rotation body 15. On the other hand, when the trunk door 2 is fully closed, and an door opening signal is sent from a door opening switch disposed at a driver's seat in a passenger compartment or a remote-control switch (not shown), the motor M is driven to rotate the rotation body 15 from the home position to the initial position. When the rotation body 15 is set to the initial or home position, the driving cam 12 is set to a neutral position.

As shown in FIG. 5, a second ratchet 17 for pulling the latch 8 is disposed below the driving cam 12 to be disposed as high as the upper step portion of the latch 8. One end of the second ratchet 17 is rotatably held by the shaft 13, and is linked with the driving cam 12 through the shaft 13. A spacer 18 is disposed between the second ratchet 11 and the driving cam 12, and is also rotatably held by the shaft 13. The other end (i.e., free end) of the second ratchet 17 has a latching portion 17*a* to be engaged with the engaging groove 8*d* in the upper step portion of the latch 8. Further, a latching pin 17*b* is disposed on the free end of the second ratchet 17.

An operation lever 19 is disposed as high as the spacer 18, and is rotatably held by the shaft 10, sharing the shaft 10 with the first ratchet 11. The operation lever 19 is biased in a counterclockwise direction in FIG. 2 around the shaft 10 by a spring (not shown) connected to the operation lever 19. The operation lever 19 has a latching pin 19*a* disposed in the vicinity of the shaft 10. The latching pin 19*a* makes contact with an outer peripheral surface of the driving cam 12. The operation lever 19 also has an arc-shaped guiding groove 19*b* having one end open, for catching and guiding the latching pin 17*b* of the second ratchet 17. The operation lever 19 is biased in the counterclockwise direction in FIG. 2. Therefore, the second ratchet 17 is also biased in such a manner that the latching pin 17*b* is pushed by an inner surface of the guiding groove 19*b*, and the latching portion 17*a* makes contact with the to outer peripheral surface of the upper step portion having the engaging groove 8*d* of the latch 8.

Further, as shown in FIG. 2, a rod 20 has a latching portion 20*a* at one end. The latching portion 20*a* is engaged with an operation arm 19*c* of the operation lever 19. The other end of the rod 20 is connected with a key cylinder 21, which is manually operated by an operator so that the trunk door 2 is opened. A detection switch 21*a* is disposed adjacent to the key cylinder 21 to detect a door opening operation by a key in the key cylinder 21.

When the key cylinder 21 is operated manually by the key so that the trunk door 2 is opened, the rod 20 is pulled toward a right direction in FIG. 2, thereby rotating the operation lever 19 with the operation arm 19*c* engaged with the latching portion 20*a* of the rod 20 in the clockwise direction in FIG. 2. When the operation lever 19 rotates in the clockwise direction in FIG. 2 due to any causes other than an operation of the rod 20, the operation arm 19*c* comes off the latching portion 20*a* of the rod 20.

Further, when the detection switch 21*a* detects the door opening operation by the key in the key cylinder 21, and the rotation body 15 is not set to the initial position, the motor M is rotated in the counterclockwise direction in FIG. 2 so that the rotation body 15 is returned to the initial position. When the rotation body 15 is already set to the initial position, the motor M is not rotated even if the detection switch 21*a* detects the door opening operation in the key cylinder 21.

Next, an operation of the door closing system 3 will be described with reference to FIGS. 2 and 6–12.

First, an operation of the door closing system 3 for closing the trunk door 2 will be described. Assuming that the trunk door 2 is in open condition, the rotation body 15 is held at the initial position as shown in FIG. 2.

Figure 6:
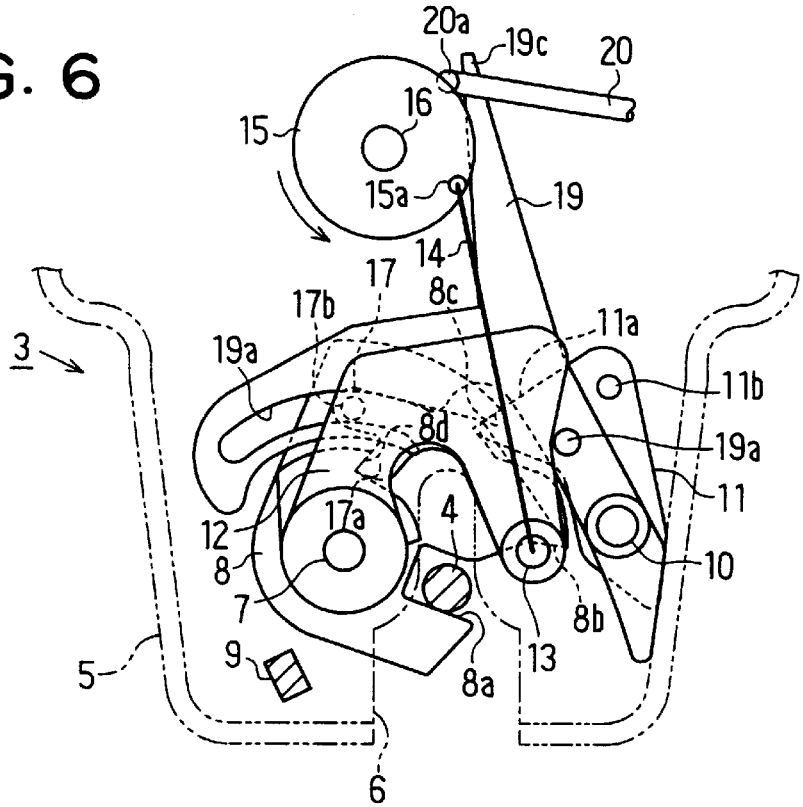
FIG. 6 is a schematic view showing the door closing system operating close a trunk door in the first embodiment.

When the trunk door 2 is closed by an insufficient force, the latch 8 is pushed by the striker 4 being inserted into the insertion passage 6 to rotate insufficiently. As a result, the latching surface 11*a* of the first ratchet 11 is engaged with the latching surface 8*c* of the latch 8. That is, the latch 8 is held at a position where the latch 8 and the striker 4 start being engaged with each other (hereinafter referred to as closing start position), as shown in FIG. 6. At this point, the latching portion 17*a* of the second ratchet 17 is engaged with the engaging groove 8*d* of the latch 8.

When the latch 8 is disposed at the closing start position, the motor M starts rotating the rotation body 15 from the initial position (FIG. 6) to the home position (FIG. 8) in a counterclockwise direction in FIG. 6, according to the position of the rotation body 15 detected by the position detector (not shown). While the rotation body 15 rotates in the counterclockwise direction in FIG. 6, the driving cam 12 connected with the link member 14 through the shaft 13 is rotated in the counterclockwise direction in FIG. 6 around the shaft 7 from the neutral position shown in FIG. 6. As a result, the latch 8 is forced to be rotated in the counterclockwise direction in FIG. 6 because the latching portion 17*a* of the second ratchet 17 is engaged with the engaging groove 8*d* of the latch 8.

Figure 7:
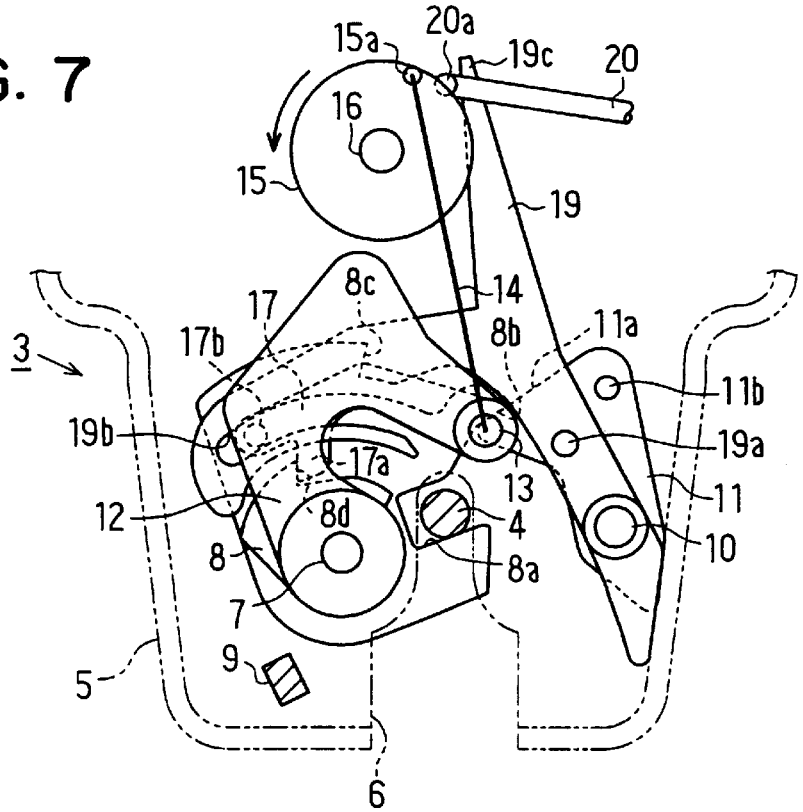
FIG. 7 is a schematic view showing the door closing system when the trunk door is fully closed in the first embodiment.

When the rotation body 15 is rotated to be disposed as shown in FIG. 7, the latching surface 11*a* of the first ratchet 11 is engaged with the latching surface 8*b* of the latch 8. That is, moving of the latch 8 is restricted in such a manner that the latch 8 is fully engaged with the striker 4, thereby fully closing the trunk door 2. Thus, the trunk door 2 is fully closed by the door closing system 3.

Even after the latch 8 is fully engaged with the striker 4, the motor M continues to be rotated until the rotation body 15 is set to the home position as shown in FIG. 8 in the counterclockwise direction in FIG. 8. When the rotation body 16 reaches the home position, the motor M stops rotation according to the position of the rotation body 15 detected by the position detector.

On the other hand, when the trunk door 2 is closed with a sufficient force, moving of the latch 8 is restricted by the first ratchet 11 in such a manner that the latch 8 is fully engaged with the striker 4. In this case, similarly to the above-mentioned case, when the latch 8 passes the closing start position, the motor M rotates the rotation body 15 in the counterclockwise direction in FIG. 6 from the initial position to the home position, according to the position of the rotation body 15 detected by the position detector.

Next, an operation of the door closing system 3 for opening the trunk door 2 will be described. Assuming that the trunk door 2 is in fully closed condition, the rotation body 15 is held at the home position as shown in FIG. 8.

When a door opening signal is sent from the door opening switch at the driver's seat or the remote-control switch, the motor M starts rotating to rotate the rotation body 15 in the counterclockwise direction in FIG. 8 from the home position to the initial position (FIG. 2). While the rotation body 15 rotates, the driving cam 12 connected with the link member 14 through the shaft 13 is rotated in the clockwise direction in FIG. 8 from the neutral position. As a result, the outer peripheral surface of the driving cam 12 makes contact with the latching pin 19*a* of the operation lever 19, thereby rotating the operation lever 19 in the clockwise direction in FIG. 9 around the shaft 10. When the operation lever 19 rotates in the clockwise direction in FIG. 9, an outer peripheral surface of the operation lever 19 makes contact with the latching pin 11*b* of the first ratchet 11, as shown in FIG. 9, thereby rotating the first ratchet 11 around the shaft 10 in the clockwise direction in FIG. 9.

Figure 9:
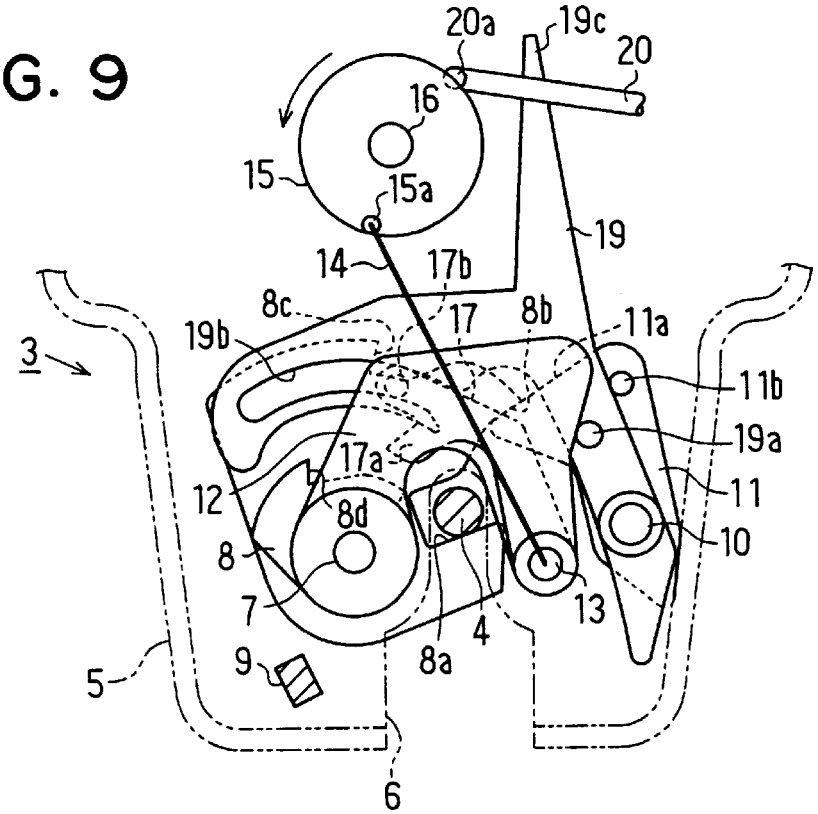

Thus, as the rotation body 15 rotates in the above-mentioned way, the driving cam 12 rotates the first ratchet 11 through the operation lever 19 in the clockwise direction in FIG. 9. As a result, the latching surface 11*a* of the first ratchet 11 comes off the latching surface 8*b* of the latch 8, as shown in FIG. 10. At this point, the guiding groove 19*b* guides the latching pin 17*b* of the second ratchet 17 so that the latching portion 17*a* of the second ratchet 17 comes off the engaging groove 8*d* of the latch 8. As a result, when the first ratchet 11 is released from the latch 8, the latch 8 rotates in reverse around the shaft 7 in the clockwise direction in FIG. 9, due to a biased force applied to the latch 8 by a spring (not shown). When the latch 8 makes contact with the stopper 9, as shown in FIG. 10, moving of the latch 8 is restricted. Hereinafter, this position of the latch 8 is referred to as an unlocking position. Thus, the striker 4 is released from the recessed portion 8*a* of the latch 8, thereby unlocking the trunk door 2.

Even after the latch 8 returns to the unlocking position, the motor M continues to rotate, thereby rotating the rotation body 15 in the counterclockwise direction in FIG. 10 until the rotation body 15 is set to the initial position. When the rotation body 15 reaches the initial position, the motor M stops rotating according to the position of the rotation body 15 detected by the position detector.

Further, when the trunk door 2 is fully closed as shown in FIG. 8, the trunk door 2 may be unlocked through the door opening operation in the key cylinder 21 using the key.

When the key cylinder 21 is operated by the key so that the trunk door 2 is opened, the rod 20 is pulled in a right direction in FIG. 8, thereby rotating the operation lever 19 in a clockwise direction in FIG. 8. As a result, as shown in FIG. 11, the outer peripheral surface of the operation lever 19 makes contact with the latching pin 11*b* of the first ratchet 11, thereby rotating the first ratchet 11 in the clockwise direction in FIG. 11 around the shaft 10.

As the operation lever 19 rotates, the latching surface 11*a* of the first ratchet 11 comes off the latching surface 8*b* of the latch 8, as shown in FIG. 12. The guiding groove 19*b* guides the latching pin 17*b* of the second ratchet 17, thereby releasing the second ratchet 17 from the engaging groove 8*d* of the latch 8. As a result, when the first ratchet 11 is released from the latch 8, the latch 8 rotates in reverse in the clockwise direction in FIG. 12 until being stopped by the stopper 9.

The detection switch 21*a* detects the door opening operation using the key in the key cylinder 21. During the door opening operation using the key, the rotation body 15 is set to the home position as shown in FIGS. 11, 12. Therefore, the motor M rotates in the counterclockwise direction in FIGS. 11, 12 according to a detection result of the detection switch 21*a* so that the rotation body 15 is rotated to the initial position. As a result, the striker 4 is released from the recessed portion 8*a* of the latch 8. Thus, the trunk door 2 can also be unlocked through the door opening operation by the key in the key cylinder 21.

Further, even when power supply to the door closing system 3 is shut off to be tentatively stopped and the latch 8 is disposed at the closing start position as shown in FIG. 6, the door closing system 3 still can open the trunk door 2 through the door opening operation by the key in the key cylinder 21.

The operation lever 19 is rotated in the clockwise direction in FIG. 11 through the rod 20 according to the door opening operation by the key in the key cylinder 21. As a result, the outer peripheral surface of the operation lever 19 makes contact with the latching pin 11*b* of the first ratchet 11, thereby rotating the first ratchet 11 in the clockwise direction in FIG. 11 around the shaft 10.

As the operation lever 19 rotates, the latching surface 11*a* of the first ratchet 11 comes off the latching surface 8*c* of the latch 8. At this point, the guiding groove 19*b* of the operation lever 19 guides the latching pin 17*b* of the second ratchet 17, thereby releasing the latching portion 17*a* from the engaging groove 8*d* of the latch 8. As a result, when the first ratchet 11 is released from the latch 8, the latch 8 rotates in reverse in the clockwise direction in FIG. 11, and makes contact with the stopper 9 to be stopped at the unlocking position. Thus, the striker 4 is released from the recessed portion 8*a* of the latch 8, thereby opening the trunk door 2.

Preferably, the door closing system 3 has a control device which detects an opening/closing state of the trunk door 2 when the power supply to the door closing system 3 is tentatively shut off and resumes, and controls the motor M so that the rotation body 15 automatically returns to an appropriate rotation position. As a result, the opening/closing state of the trunk door 2 accords with the rotation position of the rotation body 15 when the power supply to the door closing system 3 resumes, thereby reducing operation errors of the door closing system 3.

According to the first embodiment, the driving cam 12 is disposed so that the shaft 13 of the driving cam 12 is parallel to the shaft 7 of the latch 8. Therefore, the driving cam 12 and the latch 8 are disposed parallel to each other in a relatively small space, thereby reducing the size of the door closing system 3. Further, the output shaft 16 of the motor M is disposed parallel to the shaft 7 of the latch 8. Therefore, power transmission from the motor M to the driving cam 12 is performed in a relatively small space, thereby reducing the size of the door closing system 3. Furthermore, the driving cam 12 shares the same shaft 7 with the latch 8. Therefore, the driving cam 12 and the latch 8 are disposed in an even more smaller space, thereby further reducing the size of the door closing system 3.

(Second Embodiment)

A second preferred embodiment of the present invention will be described with reference to FIGS. 13A–22.

In the second embodiment, similarly to the first embodiment, a door closing system 103 is attached to a center point on the free end of the trunk door 2 in the width direction of the vehicle 1. As shown in FIGS. 13A–16, the door closing system 103 has a base plate 105 having an insertion passage 106 into which the striker 4 is inserted. As shown in FIG. 16, a supporting shaft 107 is disposed in the vicinity of the insertion passage 106 so that the shaft 107 is perpendicular to the base plate 105. A latch 108 formed into a substantially-circular plate is rotatably held by the shaft 107.

The latch 108 is formed into a two-stepped shape having upper and lower step portions, thereby having a two-stepped cross-section. Therefore, the latch 108 has larger thickness at a center part thereof than at a peripheral part thereof, and has upper and lower two peripheral side surfaces. The lower peripheral side surface of the latch 108 has a recessed portion 108*a* for catching the striker 4 and a latching surface 108*b* to be engaged with the striker 4 when the door 2 is fully closed.

The upper peripheral side surface of the latch 108 has a latching surface 108*c* to be engaged with the striker 4 when the latch 108 starts being engaged with the striker 4. The latching surfaces 108*b*, 108*c* are disposed on a side of the insertion passage 106 with respect to a rotation center of the latch 108 held by the shaft 107. That is, the latching surfaces 108*b*, 108*c* are disposed on a right side of the shaft 107 in FIGS. 13A, 13B. In the second embodiment, as shown in FIGS. 13A, 13B, when the latch 108 makes contact with a side wall 105*a* of the base plate 105 to be restricted from moving, the latch 108 is set to an original position, where the striker 4 is released from the latch 108.

Further, as shown in FIG. 15, the latch 108 has a first collision surface D1 to be engaged with a second ratchet 120 and a second collision surface D2 to be engaged with a first ratchet 110. A distance (Y1) between the center of the shaft 107 and the first collision surface D1 is smaller than a distance (Y2) between the center of the shaft 107 and the second collision surface D2, i.e., Y1<Y2.

Further, as shown in FIG. 16, a supporting shaft 109 is disposed on a side opposite to the shaft 107 with respect to the insertion passage 106 to be perpendicular to the base plate 105. A base end of the first ratchet 110 to be engaged with the latch 108 is rotatably held by the shaft 109.

The latch 108 and the first ratchet 110 respectively have hook portions 108*d*, 110*a* for holding a coil spring 111. Each end of the coil spring 111 is hooked onto the hook portions 108*d*, 110*a*, respectively, so that the coil spring 111 is disposed between the hook portions 108*d*, 110*a* with tension. As a result, the latch 108 and the first ratchet 110 are pulled toward each other due to the coil spring 111. When the latch 108 is set to the original position, the hook portion 108*d* of the latch 108 is disposed at a position shifted from a line connecting a center of the shaft 107 and the hook portion 110*a*, in a counterclockwise direction in FIGS. 13A, 13B. Therefore, the latch 108 is biased in a clockwise direction in FIGS. 13A, 13B, and the first ratchet 110 is biased in the counterclockwise direction to make contact with the lower peripheral side surface of the latch 108, by the single coil spring 111.

The first ratchet 110 has a latching surface 110*b* to be engaged with the latching surface 108*b* of the latch 108 on a free end of the first ratchet 110. When the latching surface 10*b* is engaged with the latching surface 108*b*, the latch 108 is held at a door full closing position in which the trunk door 2 is fully closed (hereinafter referred to as full closing position). Further, a latching pin 110*c* is also disposed at the free end of the first ratchet 110.

In the second embodiment, the latch 108 and the first ratchet 110 are both made of metal. Further, the latch 108 is entirely covered with a resin member 112 except the latching surfaces 108*b*, 108*c*. A base end portion including a portion around the shaft 109 of the first ratchet 110 is covered with a resin member 113. Therefore, a sliding noise occurring between the latch 108 and the base plate 105 and between the latch 108 and a driving cam 114 is largely decreased due to the resin member 112. Similarly, a sliding noise occurring between the first ratchet 110 and the base plate 105, and between the first ratchet 110 and an operation lever 122 is also largely decreased due to the resin member 113.

Further, the latching surfaces 108*b*, 108*c* of the latch 108 are exposed. Therefore, when the latching surfaces 108*b*, 108*c* are respectively engaged with the latching surface 110*b* of the first ratchet 110 and a latching portion 120*a* of a second ratchet 120, the latching surfaces 108*b*, 108*c* are restricted from being adhered to the latching surface 110*b* and the latching portion 120*a*, respectively, through melted resin.

Further, the resin member 112 has a thick portion 112*a* where the striker 4 collides. The thick portion 112*a* has a slit 112*b* for cushioning collision between the thick portion 112*a* and the striker 4. The resin member 112 also has a thick portion 112*c* where the side wall 105*a* of the base plate 105 collides.

Thus, in the second embodiment, the latch 108 and the first ratchet 110 are respectively covered with the resin member 112, 113, thereby greatly reducing the sliding noise between the latch 108 or the first ratchet 110 and other components. Further, due to the thick portion 112*a*, 112*c*, and the slit 112*b* of the resin member 112, a collision noise occurring between the latch 108 and the striker 4 or the side wall 105*a* is greatly reduced.

Further, as shown in FIGS. 14, 16, thickness (l) of the first ratchet 110 is larger than thickness (m) of the second ratchet 120, i.e., l>m.

As shown in FIG. 16, the driving cam 114 formed into a substantially C-shape is disposed above the latch 108 with the resin member 112 disposed therebetween. One end of the driving cam 114 is rotatably held by the shaft 107. A supporting shaft 115 pierces the other end of the driving cam 114 to be perpendicular to the base plate 105. A link member 116 for constituting a linkage mechanism is disposed below the driving cam 114, so that one end of the link member 116 is rotatably held by the shaft 115.

The other end of the link member 116 is rotatably held by a connection pin 117*a* disposed at one end of a connection arm 117. The connection arm 117 is secured to an output shaft 119 of an actuator 118 to rotate integrally with the output shaft 119. The actuator 118 is driven by a driving motor M. The motor M is a driving source of the door closing system 103, and rotates the connection arm 117 in one direction (i.e., counterclockwise direction in FIGS. 13A, 13B). The actuator 118 is secured to the base plate 105 through a screw (not shown).

In FIG. 13A, the connection arm 117 is held at an open home position. When the trunk door 2 is open, the connection arm 117 is constantly held at the open home position. In FIG. 19A, the connection arm 117 is held at a closed home position. When the trunk door 2 is fully closed, the connection arm 117 is constantly held at the closed home position. When the connection arm 117 is set to either the open or closed home position, the driving cam 114 connected to the connection arm 117 through the link member 116 is set to a neutral position. When the connection arm 117 is rotated, the driving cam 114 starts swinging right and left.

Further, as shown in FIG. 16, the second ratchet 120 for pulling the latch 108 is disposed below the driving cam 114 and as high as the upper step portion of the latch 108. A base end of the second ratchet 120 is rotatably held by the driving cam 114 through a supporting shaft 121, in such a manner that moving of the link member 116 is not restricted by the second ratchet 120.

The second ratchet 120 has a latching portion 120*a* to be engaged with the latching surface 108*c* of the latch 108 on a free end thereof. When the latching portion 120*a* is engaged with the latching surface 108*c*, the latch 108 is stopped at a position shown in FIGS. 17A, 17B. At this point, the trunk door 2 starts being closed. A slave pin 120*b* extending downwardly is attached to a lower surface of the free end of the second ratchet 120.

The operation lever 122 which also pulls the latch 108 is rotatably held by the shaft 109. That is, the first ratchet 110 and the operation lever 122 share the same shaft 109 with the resin member 113 disposed between the first ratchet 110 and the operation lever 122. The operation lever 122 has a hook portion 122*a* formed by cutting and raising, for holding one end of a coil spring 123. The other end of the coil spring 123 is held by a hook portion 105*b* of the base plate 105, formed by cutting and raising. Height of the hook portion 105*b* is set so that operation of the operation lever 122 is not restricted by the hook portion 105*b*. The operation lever 122 is biased in the counterclockwise direction in FIG. 13A by the coil spring 123. Further, a protruding portion 122*b* is formed by cutting and raising on the operation lever 122 in the vicinity of the shaft 9. The protruding portion 122*b* makes contact with a peripheral surface of the driving cam 114 to release the second ratchet 120 from the latch 108.

Further, the operation lever 122 has an arc-shaped guiding groove 122*c* for catching and guiding the slave pin 120*b* of the second ratchet 120. Since the operation lever 122 is biased in the counterclockwise direction in FIG. 13A, the second ratchet 120 is biased so that the slave pin 120*b* is pushed by an inner peripheral surface of the guiding groove 122*c*, and the latching portion 120*a* makes contact with the latching surface 108*c* of the upper step portion of the latch 108. When the latch 108 is held at the closing start position as shown in FIGS. 17A, 17B, the operation lever 122 is rotated in a counterclockwise direction due to a biasing force of the coil spring 123. As a result, the latching portion 120*a* of the second ratchet 120 is engaged with the latching surface 108*c* of the latch 108. At this point, the latching portion 120*a* collides with the outer peripheral surface of the latch 108.

However, the latch 108 is covered with the resin member 112, thereby restricting collision noise from occurring.

Further, the operation lever 122 has an operation arm 122*d*, which is connected with a door handle (not shown). When the door handle is operated so that the trunk door 2 is opened, the operation lever 122 is rotated in the clockwise direction in FIG. 13A.

A limit switch 124 is disposed on the base plate 105 in the vicinity of the operation lever 122. When the latch 108 is disposed at the closing start position, and the operation lever 122 is rotated in the counterclockwise direction, a needle of the limit switch 124 is tilted by a protruding portion 22*e* formed on the operation lever 122, thereby activating the limit switch 124.

Referring to FIG. 21, the actuator 118 has a case 118*a*, the motor M for driving the actuator 118, a reduction gear unit 130 for reducing a rotation speed of the motor M, and a detection sensor 131 for detecting a rotation position of the connection arm 117. The motor M, the reduction gear unit 130, and the detection sensor 131 are integrally attached inside the case 118*a*. The case 118*a* has three mounting legs 118*b* through which the case 118*a* is mounted to the base plate 105. One of the mounting legs 118*b* is disposed as shown in FIG. 21, and the other two mounting legs 118*b* are disposed on a rear surface of the case 118*a* so that the output shaft 119 is disposed between the two mounting legs 118*b*. Each of the mounting legs 118*b* is secured to the base plate 105 through a screw so that the actuator 118 is integrally attached to the base plate 105.

The reduction gear unit 130 has four reduction gears 133–136. The reduction gears 133–136 are sequentially connected to a worm 132, which is attached to a rotation shaft of the motor M. The output shaft 119 is secured to the reduction gear 136 which rotates last of the four reduction gears 133–136. A plate 137 made of insulating material is attached to one circular rotating surface 136*a* of the reduction gear 136. Further, a predetermined-shaped pattern 138 made of electric conductor is attached on the plate 137.

A substrate 139 is mounted inside the case 118*a*, and first to third contacts 140–142 for sliding on the pattern 138 are secured to the substrate 139. The first to third contacts 140–142 are disposed to make contact with the pattern 138 on the same line extending in a diameter direction. The first contact 140 slides on an outer circumferential portion of the to pattern 138, the second contact 141 slides on a middle circumferential portion of the pattern 138, and the third contact 142 slides on an inner circumferential portion of the pattern 138. In the outer and middle circumferential portions of the pattern 138, the plate 137 is exposed in a range defined by a predetermined angle. On the other hand, the inner circumferential portion of the pattern 138 is fully covered by the electric conductor along the whole circumference without any exposure of the plate 137.

When the reduction gear 136 rotates, the plate 137 and the pattern 138 also rotates. As a result, a connection state between the first and second contacts 140, 141 and the third contact 142 is changed, thereby producing detection signals (SG1, SG2) indicating a rotation position of the connection arm 117. Thus, the first to third contacts 140–142, the plate 137, and the pattern 138 constitute a detection sensor 131.

When the reduction gear 136 is disposed as shown in FIGS. 13A, 17A, the connection arm 117 is set to the open home position. At this point, the first contact 140 is not connected with the third contact 142 through the pattern 138, and the second contact 141 is connected with the third contact 142 through the pattern 138.

While the connection arm 117 rotates in the counterclockwise direction in FIG. 13A exceeding the open home position shown in FIGS. 13A, 17A before reaching the closed home position shown in FIG. 19A, both the first and second contacts 140, 141 are connected with the third contact 142 through the pattern 138.

When the connection arm 117 is disposed at the closed home position shown in FIG. 19A, the first and second contacts 140, 141 are not connected with the third contact 142 through the pattern 138.

While the connection arm 117 rotates in the counterclockwise direction in FIG. 19A exceeding the closed home position shown in FIG. 19A before reaching the open home position shown in FIGS. 13A, 17A, the first contact 140 is connected with the third contact 142 through the pattern 138, and the second contact 141 is not connected with the third contact 142 through the pattern 138.

That is, only when the connection arm 117 is set to the open home position shown in FIGS. 13A, 17A or the closed home position shown in FIG. 19A, the first contact 140 is not connected with the third contact 142 through the pattern 138. Further, while the connection arm 117 is disposed at the open home position shown in FIGS. 13A, 17A or rotates exceeding the open home position before reaching the closed home position shown in FIG. 19A, the second contact 141 is connected with the third contact 142 through the pattern 138. While the connection arm 117 is disposed at the closed home position shown in FIG. 19A or rotates exceeding the closed home position before reaching the open home position shown in FIGS. 13A, 17A, the second contact 141 is not connected with the third contact 142 through the pattern 138.

Therefore, when the first contact 140 is not connected with the third contact 142, it is determined that the connection arm 117 is set to either the open home position shown in FIGS. 13A, 17A, or the closed home position shown in FIG. 19A. Further, when the second contact 141 is connected with the third contact 142, it is determined that the connection arm 117 is disposed at the open home position or at a rotation position in a range between the open home position and the closed home position. When the second contact 141 is not connected with the third contact 142, it is determined that the connection arm 117 is disposed at the closed home position or at a rotation position in a range between the closed home position and the open home position.

Referring to FIG. 22, the door closing system 103 is electrically controlled by a door closing control device 143 (hereinafter referred to as control device 143) mounted on the vehicle 1. The control device 143 has a control circuit 144.

The first and second contacts 140, 141 of the detection sensor 131 are connected with input ports P1, P2 of the control circuit 144, respectively. The third contact 142 is grounded and is connected with the input port P3 through the limit switch 124. When the limit switch 124 is activated, the input port P3 is not grounded. When the limit switch 124 is not activated, the input port P4 is grounded. The input port P4 of the control circuit 144 is grounded through a door opening switch 145 for opening the trunk door 2 such as a driver's seat opening switch or a remote-control switch.

When the first and second contacts 140, 141 are connected with the third contact 142 through the pattern 138, the first and second contacts 140, 141 are grounded, thereby sending ground-level (hereinafter referred to as level L) detection signals SG1, SG2 to the input ports P1, P2, respectively. On the other hand, the first and second contacts 140, 141 are not connected with the third contact 142 through the pattern 138, the first and second contacts 140, 141 are not grounded, thereby sending unground-level (hereinafter referred to as level H) detection signals SG1, SG2 to input ports P1, P2. When the limit switch 124 is activated, the input port P3 becomes level H. When the limit switch 124 is not activated, an activation signal SG3 of level L is sent to the input port P3. When the door opening switch 145 is turned on so that the trunk door 2 is opened, a door opening signal SG4 of level L is sent to the input port P4.

Further, an excitation coil 146*b* for switching a switch 146*a* disposed inside a relay 146 is connected between the input ports P5, P6 of the control circuit 144. The switch 146*a* is connected with a positive pole of the motor M. A negative pole of the motor M is grounded through a positive temperature coefficient thermistor (hereinafter referred to as PTC) 147 as a protection circuit for the motor M. When the excitation coil 146*a* is excited, the positive pole of the motor M is connected with a battery +B through the switch 146*a* so that power is supplied to the motor M. When the excitation coil 146*a* is not excited, the positive pole of the motor M is grounded, thereby cutting off power supply to the motor M.

While the connection arm 117 is set to the open home position or to a rotation position in a range between the open home position shown in FIGS. 13A, 17A and the closed home position shown in FIG. 19A, the second contact 141 is connected with the third contact 142, thereby sending the detection signal SG2 of level L to the input port P2 of the control circuit 144. Therefore, the control circuit 144 detects that the connection arm 117 is disposed at the open home position or at a rotation position in a range between the open home position and the closed home position according to the level L detection signal SG2. Particularly, when the connection arm 117 is set to the open home position, the first contact 140 is not connected with the third contact 142, thereby sending the detection signal SG1 of level H to the input port P1 of the control circuit 144. Therefore, the control circuit 144 detects that the connection arm 117 is set to the open home position according to the level H detection signal SG1.

While the connection arm 117 is set to the closed home position or to a rotation position in a range between the closed home position and the open home position, the second contact 141 is not connected with the third contact 142, thereby sending the detection signal SG2 of level H to the input port P2 of the control circuit 144. Therefore, the control circuit 144 detects that the connection arm 117 is disposed at the closed home position or at a rotation position in a range between the closed home position and the open home position according to the level H detection signal SG2. Particularly, when the connection arm 117 is set to the closed home position, the first contact 140 is not connected with the third contact 142, thereby sending the detection signal SG1 of level H to the input port P1 of the control circuit 144. Therefore, the control circuit 144 detects that the connection arm 117 is set to the closed home position according to the level H detection signal SG1.

Further, when the latch 108 is shifted from the original position shown in FIGS. 13A, 13B to the closing start position shown FIGS. 17A, 17B, the limit switch 124 is activated, thereby sending the activation signal SG3 of level H to the input port P3 of the control circuit 144. The control circuit 144 excites the excitation coil 146*b* according to the level H activation signal SG3. When the excitation coil 146*b* is excited, the positive pole of the motor M is connected with the battery +B through the switch 146*a*, thereby supplying power to the motor M. That is, the control device 143 rotates the motor M, thereby rotating the connection arm 117 disposed at the open home position with the reduction gear 136 in the counterclockwise direction. At this point, the pattern 138 also rotates in the counterclockwise direction as the reduction gear 136 rotates, thereby connecting the first contact 140 with the third contact 142. Therefore, the detection signal SG1 sent to the input port P1 is shifted from level H to level L.

When the connection arm 117 reaches the closed home position shown in FIG. 19A, the first contact 140 is not connected with the third contact 142. That is, the detection signal SG1 sent to the input port P1 is shifted from level L to level H. The control circuit 144 does not excite the excitation coil 146*b* according to the level H detection signal SG1. When the excitation coil 146*b* is not excited, the positive pole of the motor M is grounded through the switch 146*a*, thereby cutting off the power supply to the motor M. That is, the control device 143 stops rotation of the motor M.

Further, at this point, when the door opening switch 145 is turned on, the level L door opening signal SG4 is sent to the input port P4, and the control circuit 144 excites the excitation coil 146*b* according to the level L door opening signal SG4. As a result, the positive pole of the motor M is connected with the battery +B through the switch 146*a*, so that power is supplied to the motor M. That is, the control device 143 rotates the motor M, thereby rotating the connection arm 117 disposed at the closed home position with the reduction gear 136 in the counterclockwise direction. As a result, the pattern 138 also rotates in the counterclockwise direction as the reduction gear 136 rotates, thereby connecting the first contact 140 with the third contact 142. That is, the detection signal SG1 sent to the input port P1 is shifted from level H to level L.

When the connection arm 117 reaches the open home position shown in FIG. 13A, the first contact 140 is not connected with the third contact 142. That is, the detection signal SG1 sent to the input port P1 is shifted from level L to level H. The control circuit 144 does not excite the excitation coil 146*b* according to the level H detection signal SG1. As a result, the positive pole of the motor M is grounded through the switch 146*a*, thereby cutting off the power supply to the motor M. That is, the control device 143 stops rotation of the motor M.

Next, operation of the door closing system 103 will be described. The operation of the door closing system 103 includes two types of operation; a locking operation and an unlocking operation.

(Locking Operation)

The locking operation is an operation for fully closing the opened trunk door 2, which includes an operation for guiding the latch 108 to the closing start position so that the latch 108 is engaged with the second ratchet 120 (hereinafter referred to as a closing start position guiding operation), and an operation for guiding the latch 108 to the full closing position where the latch 108 is fully engaged with the first ratchet 110 and the trunk door 2 is fully closed (hereinafter to as a closing operation).

1. Closing Start Position Guiding Operation

Assuming that the trunk door 2 is open, the latch 108 is held at the original position, and the connection arm 117 is held at the open home position, as shown in FIGS. 13A, 13B. At this point, the first contact 140 is connected with the third contact 142, thereby sending the level H detection signal SG1 to the input port P1.

Further, at this point, since the limit switch 124 is not activated, the input port P3 of the control circuit 144 is grounded through the limit switch 124. That is, the level L detection signal SG3 is sent to the input port P3. The door opening switch 145 is also not activated, thereby sending the level H detection signal SG4 to the input port P4.

When the latch 108 is pushed by the striker 4 inserted into the insertion passage 106 against the biasing force of the coil spring 111, and is set to the closing start position where the latch 108 can be engaged with the latching portion 120*a* of the second ratchet 120, the operation lever 122 is rotated in the counterclockwise direction due to a biasing force of the coil spring 123 as shown in FIG. 17A. As a result, the latching portion 120*a* of the second ratchet 120 is engaged with the latching surface 108*c* of the latch 108, thereby restricting further rotation of the latch 108 from the closing start position in the clockwise direction.

Further, when the operation lever 122 rotates in the counterclockwise direction, the limit switch 124 is activated by the protruding portion 122*e* of the operation lever 122, thereby sending the level H activation signal SG3 to the input port P3.

The motor M does not operate during the closing start position guiding operation. Therefore, the connection arm 117 is maintained at the open home position during the closing start position guiding operation. That is, the level H detection signal SG1 continues to be sent to the input port P1 during the closing start position guiding operation.

2. Closing Operation

When the limit switch 124 is activated and the level H activation signal SG3 is sent to the input port P3, the control circuit 144 excites the excitation coil 146*b* according to the level H activation signal SG3. As a result, the positive pole of the motor M is connected with the battery +B, so that power is supplied to the motor M. That is, the control device 143 rotates the motor M, thereby rotating the connection arm 117 at the open home position with the reduction gear 136 in the counterclockwise direction. At the same time, the pattern 138 also rotates as the reduction gear 136 rotates, thereby connecting the first contact 140 with the third contact 142. That is, the detection signal SG1 sent to the input port P1 is shifted from level H to level L.

As the connection arm 117 rotates in the counterclockwise direction, the driving cam 114 connected with the link member 116 through the shaft 115 is rotated in the counterclockwise direction from the neutral position shown in FIG. 17A around the shaft 107. As a result, the latch 108 is forced to be rotated in the counterclockwise direction due to rotation of the driving cam 114, because the latching portion 120*a* of the second ratchet 120 connected with the driving cam 114 through the shaft 121 is engaged with the latching surface 108*c* of the latch 108.

When the latch 108 is rotated so that the latching surface 108*b* of the latch 108 can be engaged with the latching surface 110*b* of the first ratchet 110, the first ratchet 110 is rotated in the counterclockwise direction due to a biasing force of the coil spring 111. When the connection arm 117 reaches an upper dead point as shown in FIG. 18A, the latching surface 110*b* of the first ratchet 110 is released from the latching surface 108*b* of the latch 108. As a result, a space is provided between the first ratchet 110 and the latch 108, thereby enabling the first ratchet 110 to rotate in the counterclockwise direction while passing through the space.

When the connection arm 117 further rotates in the counterclockwise direction, the driving cam 114 is rotated in the clockwise direction and the latch 108 is rotated in the clockwise direction due to the biasing force of the coil spring 111. When the latching surface 110*b* of the first ratchet 110 is engaged with the latching surface 108*b* of the latch 108, that is, the latch 108 is at the full closing position, the latch 108 is restricted from further rotating from the full closing position, thereby fully closing the trunk door 2.

Even after the latch 108 is set to the full closing position, the control device 143 continues to rotate the motor M, thereby rotating the connection arm 117 to the closed home position in the counterclockwise direction. When the connection arm 117 reaches the closed home position, the first contact 140 is not connected with the third contact 142 through the pattern 138. As a result, the detection signal SG1 sent to the input port P1 is shifted from level L to level H.

Therefore, the control device 144 excites the excitation coil 146*b* according to the level H detection signal SG1. As a result, the positive pole of the motor M is grounded through the switch 146*a*, thereby cutting off power supply to the motor M. That is, the control device 143 stops rotation of the motor M, and the driving cam 114 is set to the neutral position and the connection arm 117 is set to the closed position.

The connection arm 117 is set to the open home position or at a rotation position in a range between the open home position and the closing home position during the closing operation. Therefore, the second contact 141 is connected with the third contact 142 through the pattern 138 during the closing operation. That is, the level L detection signal SG2 continues to be sent to the input port P2 during the closing operation.

(Unlocking Operation)

The unlocking operation is an operation for opening the fully closed trunk door 2, that is, an operation for releasing the latch 108 from the first ratchet 110 and returning the latch 108 to the original position.

When the trunk door 2 is fully closed, the latch 108 is set to the full closing position, and the connection arm 117 is set to the closed home position, as shown in FIG. 19A. At this point, the first contact 140 is not connected with the third contact 142 through the pattern 138, thereby sending the level H detection signal SG1 to the input port P1.

When the door opening switch 145 is turned on, the door opening signal SG4 sent to the input port P4 is shifted from level H to level L. The control circuit 144 excites the excitation coil 146*b* according to the level L door opening signal SG4. As a result, the positive pole of the motor M is connected with the battery +B so that power is supplied to the motor M. That is, the control device 143 rotates the motor M, thereby rotating the connection arm 117 at the closed home position with the reduction gear 136 in the counterclockwise direction. The pattern 138 is also rotated in the counterclockwise direction as the reduction gear 136 rotates, thereby connecting the first contact 140 with the third contact 142. That is, the detection signal SG1 sent to the input port P1 is shifted from level H to level L.

As the connection arm 117 rotates in the counterclockwise direction, the driving cam 114 connected with the link 116 through the shaft 115 is rotated in the clockwise direction from the neutral position shown in FIG. 19A around the shaft 107. When the driving cam 114 further rotates, the outer peripheral surface of the driving cam 114 makes contact with the protruding portion 122*b* of the operation lever 122, thereby rotating the operation lever 122 around the shaft 109 in the clockwise direction. At this point, since the latching pin 110*c* of the first ratchet 110 makes contact with the outer peripheral surface of the operation lever 122, the first ratchet 110 is rotated in the clockwise direction around the shaft 109.

Thus, as shown in FIGS. 20A, 20B, the latching surface 110*b* of the first ratchet 110 is released from the latching surface 108*b* of the latch 108. At this point, the second ratchet 120 is released from the latching surface 108*c* of the latch 108 as the operation lever 122 rotates, because the slave pin 120*b* of the second ratchet 120 is guided by the guiding groove 122*c* of the operation lever 122. As a result, when the first ratchet 110 is released from the latch 108, the latch 108 rotates in the clockwise direction around the shaft 107 due to the biasing force of the coil spring 111, and makes contact with the side wall 105*a* of the base plate 105 to be restricted from further rotating. That is, the latch 108 returns to the original position.

Even after the latch 108 returns to the original position, the control device 143 continues to rotate the motor M, thereby rotating the connection arm 117 in the counterclockwise direction to the open home position shown in FIG. 13A. When the connection arm 117 reaches the open home position, the first contact 140 is not connected with the third contact 142 through the pattern 138. As a result, the detection signal SG1 sent to the input port P1 is shifted from level L to level H.

Therefore, the control circuit 144 excites the excitation coil 146*b* according to the level H detection signal SG1. As a result, the positive pole of the motor M is grounded, thereby cutting off power supply to the motor M. That is, the control device 143 stops rotation of the motor M, and the driving cam 114 is set to the neutral position and the connection arm 117 is set to the open home position.

During the unlocking operation, the connection arm 117 is disposed at the closed home position or at a rotation position in a range between the closed home position and the open home position, and the second contact 141 is not connected with the third contact 142 through the pattern 138. Therefore, the level H detection signal SG2 continues to be sent to the input port P2 during the unlocking operation.

When the power supply to the door closing system 103 is shut off during the closing operation or the unlocking operation to tentatively stop the operation of the door closing system 103 and resumes, the door closing system 103 operates as follows.

Provided that the door closing system 103 does not operate when the connection arm 117 is set to either the opened or closed home position, that is, when the first contact 140 is not connected with the third contact 142, thereby sending the level H detection signal SG1 to the input port Pl. That is, the door closing system 103 only operates when the first contact 140 is connected with the third contact 142, thereby sending the level L detection signal SG1 to the input port P1.

(When the power supply to the door closing system 103 is shut off during the closing operation)

During the closing operation, as mentioned above, the connection arm 117 is disposed at the open home position or at a rotation position in a range between the open home position and the closed home position, thereby connecting the second contact 141 with the third contact 142. Therefore, during the closing operation, the level L detection signal SG2 continues to be sent to the input port P2.

Therefore, when the power supply to the door closing system 103 resumes, the control circuit 144 rotates the motor M so that the connection arm 117 is rotated to the closed home position according to the level L detection signal SG2 and the level L detection signal SG1. Thus, the closing operation is resumed.

(When the power supply to the door closing system 103 is shut off during the unlocking operation)

During the unlocking operation, as mentioned above, the connection arm 117 is disposed at the closed home position or at a rotation position in a range between the closed home position and the open home position, thereby making the second contact 141 not connected with the third contact 142. Therefore, during the unlocking operation, the level H detection signal SG2 continues to be sent to the input port P2.

Therefore, when the power supply to the door closing system 103 resumes, the control circuit 144 rotates the motor M so that the connection arm 117 is rotated to the open home position according to the level H detection signal SG2 sent the input port P2 and the level L detection signal SG1 sent to the input port P1. Thus, the unlocking operation is resumed.

Therefore, in the second embodiment, when the power supply to the door closing system 103 is once shut off and resumes, it can be determined whether the door closing system 103 has been in the closing operation or the unlocking operation. As a result, the door closing system 103 resumes the operation correctly.

According to the second embodiment, the pattern 138 is disposed on the circular surface 136*a* of the reduction gear 136, and the first to third contacts 140–142 slide on the pattern 138. As the motor M rotates to rotate the pattern 138 of the reduction gear 136, a connection state between the first/second contacts 140, 141 and the third contact 142 is changed, thereby sending the detection signals SG1, SG2 to the control circuit 144. The control circuit 144 detects the rotation position of the reduction gear 136 according to the detection signals SG1, SG2. Therefore, the door closing system 103 can be controlled correctly using a single position detection sensor, thereby reducing the numbers of parts, the number of assembly processes and the size of the door closing system 103.

Further, in the second embodiment, the first to third contacts 140–142 slide on the pattern 138, thereby detecting rotation position of the reduction gear 136. Therefore, even when the power supply to the door closing system 103 is shut off and resumes, it can be determined that whether the door closing system 103 has been performing the closing operation or the unlocking operation. Thus, the door closing system 103 resumes the operation correctly.

Further, the pattern 138 is integrally attached to the reduction gear 136 without any special member for mounting the pattern 138 on the reduction gear 136. Therefore, the number of parts and the number of assembly processes of the door closing system 103 is reduced.

The detection sensor 131 which includes the reduction gear 136 having the pattern 138 and the first to third contacts 140–142 is disposed inside the case 118*a* of the actuator 118. Therefore, the detection sensor 131 is not exposed outside, and is restricted from making contact with dirt, dust and water.

Further, in the second embodiment, the distance (Y1) between the center of the shaft 107 and the first collision surface D1 of the latch 108 is set to be smaller than the distance (Y2) between the center of the shaft 107 and the second collision surface D2 of the latch 108. Therefore, moving distance of the second ratchet 120 within the guiding groove 122*c* of the operation lever 122 is decreased, thereby decreasing a moving range of the connection arm 117. As a result, the size of the door closing system 103 is reduced.

Further, in the second embodiment, the thickness (1) of the first ratchet 110 is set to be larger than the thickness (m) of the second ratchet 120. The first ratchet 110 receives a larger force from the latch 108 in comparison with the second ratchet 120. Therefore, the second ratchet 120 can have a relatively large strength to resist the force applied by the latch 108 without increasing the size of the door closing system 103.

The structure of the detection sensor 131 is not limited to the one described in the second embodiment. For example, the pattern 138 may be attached to the reduction gears 133–135 instead of the reduction gear 136.

Further, the detection sensor 131 may be formed of a rotary potentiometer in which voltage of the detection signal changes according to the rotation position of the reduction gear 136.

Further, the detection sensor 131 may be an optical sensor which optically detects the rotation position of the reduction gear 136. In this case, the pattern 138 is made of material which can be optically detected, and the first to third contacts 140–142 are replaced with light-intercepting members.

The detection sensor 131 may be disposed outside the case 118*a* of the actuator 118. For example, the connection arm 117 may be formed into a circular plate as a rotation body to which the pattern 138 is attached.

The door closing system 130 may be attached to any door of the vehicle 1 other than the trunk door 2.

Although the present invention has been fully described connection with the preferred embodiment thereof with reference to the accompanying drawings, it is to be noted that various changes and modifications will become apparent to those skilled in the art.

Such changes and modifications are to be understood as being within the scope of the present invention as defined by the appended claims.

What is claimed is:

1. A door locking-unlocking system for locking and unlocking a door through engagement of said door to a striker, said door locking-unlocking system comprising:

an actuator having a rotatable output shaft;

a latch rotatably disposed at a position to be engaged with said striker and biased in a direction to be released from said striker, said latch having a rotation shaft disposed in parallel with said output shaft of said actuator;

a latching member to be engaged with said latch for restricting said latch from moving from a full closing position where said door is fully closed;

a pulling member to be engaged with said latch for rotating said latch from a closing start position where said latch starts being engaged with said striker and said door starts being closed to said full closing position;

a releasing member for releasing said latch from said latching member; and a cam driven to rotate by said actuator for driving said pulling member and said releasing member, said cam having a rotation shaft disposed in parallel with said rotation shaft of said latch.

2. The door locking-unlocking system according to claim 1, wherein said cam is rotatably held by said rotation shaft of said latch.

3. The door locking-unlocking system according to claim 1, further comprising:

a rotation body driven to rotate by said actuator;

a link member disposed between said cam and said rotation body, for rotating said cam according to rotation of said rotation body thereby driving said pulling member and said releasing member;

a pattern disposed on a surface of said rotation body, for detecting a rotation position of said rotation body; and detection means for detecting said pattern and producing a detection signal which indicates said rotation position of said rotation body.

4. The door locking-unlocking system according to claim 3, wherein:

said pattern is made of electric conductor formed into a predetermined shape; and said detection means includes a plurality of slide members which slide on said pattern.

5. The door locking-unlocking system according to claim 4, wherein said rotation body is a reduction gear for reducing a rotation speed of said actuator.

6. The door locking-unlocking system according to claim 3, wherein said rotation body is a reduction gear for reducing a rotation speed of said actuator.

7. The door locking-unlocking system according to claim 3, further comprising:

a case for accommodating said actuator, wherein:

said rotation body is mounted inside said case integrally with said actuator; and said detection means are disposed inside said case.

8. The door locking-unlocking system according to claim 3, wherein said pulling member is engaged with said latch at said closing start position.

9. The door locking-unlocking system according to claim 3, wherein said latching member is engaged with said latch due to a biasing force applied to said latching member in a direction toward said latch when said latch is disposed at said full closing position.

10. The door locking-unlocking system according to claim 3, wherein said latch returns to an original position where said striker can be introduced into said latch due to a biasing force applied to said latch in a direction for releasing said latch from said striker when said releasing member releases said latch from said latching member.

11. The door locking-unlocking system according to claim 3, wherein:

said latch includes a first surface with which said pulling member is engaged, and a second surface with which said latching member is engaged; and distance between said rotation shaft of said latch and said first surface is smaller than distance between said rotation shaft of said latch and said second surface.

12. The door locking-unlocking system according to claim 3, wherein thickness of said latching member is larger than that of said pulling member.

* * * * *